US008942351B2

(12) United States Patent
Cheung et al.

(10) Patent No.: US 8,942,351 B2
(45) **Date of Patent: *Jan. 27, 2015**

(54) SYSTEMS AND METHODS FOR CARGO SCANNING AND RADIOTHERAPY USING A TRAVELING WAVE LINEAR ACCELERATOR BASED X-RAY SOURCE USING PULSE WIDTH TO MODULATE PULSE-TO-PULSE DOSAGE

(75) Inventors: Stephen Wah-Kwan Cheung, Mountain View, CA (US); Roger Heering Miller, Mountain View, CA (US); Juwen Wang, Sunnyvale, CA (US)

(73) Assignee: Accuray Incorporated, Sunnyvale, CA (US)

( * ) Notice: Subject to any disclaimer, the term of this patent is extended or adjusted under 35 U.S.C. 154(b) by 303 days.

This patent is subject to a terminal disclaimer.

(21) Appl. No.: 13/473,499

(22) Filed: May 16, 2012

(65) Prior Publication Data

US 2012/0294423 A1 Nov. 22, 2012

Related U.S. Application Data

(63) Continuation-in-part of application No. 12/976,787, filed on Dec. 22, 2010.

(60) Provisional application No. 61/389,149, filed on Oct. 1, 2010.

(51) Int. Cl.
*H05G 1/52* (2006.01)
*H05H 9/02* (2006.01)
(Continued)

(52) U.S. Cl.
CPC . *H05H 7/02* (2013.01); *H05H 9/02* (2013.01); *H05H 7/12* (2013.01); *H05H 9/048* (2013.01)
USPC ..... 378/113; 378/57; 378/65; 378/109

(58) Field of Classification Search
USPC ..... 378/57, 65, 91, 95, 96, 97, 101, 106, 378/108, 109, 113
See application file for complete search history.

(56) References Cited

U.S. PATENT DOCUMENTS 3,820,035 A 6/1974 Meddaugh
4,286,192 A 8/1981 Tanabe et al.
(Continued)

FOREIGN PATENT DOCUMENTS

JP 2008198522 8/2008
JP 2008218053 9/2008
(Continued)

OTHER PUBLICATIONS

Satoh, M. et al., Development of a New Initial-Loading Comprehension System and Its Application to a Free Electron-Laser LINAC, Feb. 2009.
(Continued)

*Primary Examiner* — Jurie Yun
(74) *Attorney, Agent, or Firm* — Lowenstein Sandler LLP

(57) ABSTRACT

Provided herein are systems and methods for operating a traveling wave linear accelerator to generate stable electron beams at two or more different intensities by varying the number of electrons injected into the accelerator structure during each pulse by varying the width of the beam pulse, i.e., pulse width. The electron beams may be used to generate x-rays having selected doses and energies, which may be used for cargo scanning or radiotherapy applications.

21 Claims, 16 Drawing Sheets

(51) Int. Cl.

| | |
|---|---|
| ***H05H 7/12*** | (2006.01) |
| ***H05H 9/04*** | (2006.01) |
| ***H05H 7/02*** | (2006.01) |

(56) References Cited

U.S. PATENT DOCUMENTS

| | | | | |
|---|---|---|---|---|
| 4,382,208 | A | 5/1983 | Meddaugh et al. | |
| 4,629,938 | A | 12/1986 | Whitham | |
| 4,713,581 | A | 12/1987 | Haimson | |
| 5,796,314 | A | 8/1998 | Tantawi et al. | |
| 5,801,598 | A | 9/1998 | Tantawi et al. | |
| 5,949,811 | A | 9/1999 | Baba et al. | |
| 6,433,349 | B2 | 8/2002 | Akiyama et al. | |
| 6,459,761 | B1 | 10/2002 | Grodzins et al. | |
| 6,459,762 | B1 | 10/2002 | Wong et al. | |
| 7,005,809 | B2 | 2/2006 | Whitham et al. | |
| 7,112,924 | B2 | 9/2006 | Hanna | |
| 7,130,371 | B2 | 10/2006 | Elyan et al. | |
| 7,202,486 | B2 | 4/2007 | Gentry et al. | |
| 7,239,095 | B2 | 7/2007 | Ho et al. | |
| 7,250,618 | B2 | 7/2007 | Sogard et al. | |
| 7,391,849 | B2 | 6/2008 | Smith | |
| 7,580,505 | B2 | 8/2009 | Kang et al. | |
| 7,645,994 | B2 | 1/2010 | Tang et al. | |
| 7,646,851 | B2 | 1/2010 | Liu et al. | |
| 7,881,424 | B2 | 2/2011 | Zhang et al. | |
| 8,232,748 | B2 | 7/2012 | Treas et al. | |
| 8,284,898 | B2 | 10/2012 | Ho et al. | |
| 8,311,187 | B2 | 11/2012 | Treas et al. | |
| 8,451,974 | B2 | 5/2013 | Morton | |
| 8,472,583 | B2 | 6/2013 | Star-Lack et al. | |
| 8,530,849 | B2 | 9/2013 | Boyd et al. | |
| 2003/0086527 | A1 | 5/2003 | Speiser et al. | |
| 2004/0262539 | A1 | 12/2004 | Yui et al. | |
| 2005/0057198 | A1 | 3/2005 | Hanna | |
| 2007/0035260 | A1 | 2/2007 | Ho et al. | |
| 2007/0140422 | A1 | 6/2007 | Elyan et al. | |
| 2007/0215813 | A1 | 9/2007 | Whittum et al. | |
| 2007/0248214 | A1 | 10/2007 | Smith | |
| 2007/0269013 | A1 | 11/2007 | Liu et al. | |
| 2008/0037843 | A1 | 2/2008 | Fu et al. | |
| 2008/0191645 | A1 | 8/2008 | Aoi et al. | |
| 2010/0034355 | A1 | 2/2010 | Langeveld et al. | |
| 2010/0038563 | A1 | 2/2010 | Chen et al. | |
| 2010/0111388 | A1 | 5/2010 | Seppi et al. | |
| 2010/0188027 | A1 | 7/2010 | Treas et al. | |
| 2010/0310045 | A1 | 12/2010 | Brown et al. | |
| 2011/0006708 | A1 | 1/2011 | Ho et al. | |
| 2012/0081042 | A1 | 4/2012 | Cheung et al. | |
| 2012/0294422 | A1* | 11/2012 | Cheung et al. | 378/65 |
| 2013/0230140 | A1 | 9/2013 | Mastronardi et al. | |

FOREIGN PATENT DOCUMENTS

| | | |
|---|---|---|
| WO | 2007134514 | 11/2007 |
| WO | 2009080080 | 7/2009 |
| WO | 2010019228 | 2/2010 |

OTHER PUBLICATIONS

Pont, M., Status of the 100MeV Preinjector for the ALBA Synchroton, Proceedings of EPAC08, Genoa, Italy, Jul. 2008, pp. 811-813.

AOI et al., SU-FF-T-155: Development of an ultra-small C-band linear accelerator guide and automatic frequency controller, Med. Phys., vol. 34, issue 6, Jun. 2007, pp. 2436-2437.

Birdsey et al., Pierce geometry electron guns as off-the-shelf nanosecond pulsed electron sources, Australian Institute of Physics 17th National Congress, Brisbane, Dec. 3-8, 2006, 4 pages.

Chetverikov et al., The tuning method of the biperiodic accelerating structure of electron linear accelerator, Problems of Atomic Science and Technology (PAST), Ukraine, 2001, No. 3, pp. 99-100.

Dovbnya et al., Two-frequency klystron amplifier, XVII International Linac Conference, Geneva, Switzerland, Aug. 26-30, 2006, 3 pages.

Green, Linear accelerators for radiation therapy, second edition, Taylor & Francis Group, New York, NY, pp. 27-47 (1997).

Guo et al., Active RF pulse compression using an electricity controlled semiconductor switch, New Journal of Physics 8 (2006) 293, 17 pages.

Guo et al., Active RF pulse compression using electrically controlled semiconductor switches, Contributed to 12th Advanced Accelerator Concepts Workshop (AAC 2006), Jul. 10, 2006 to Jul. 15, 2006, Lake Geneva, Wisconsin, 7 pages.

Guo et al., Active RF pulse compression using electrically controlled semiconductor switches, Proceedings of EPAC 2006, Edinburgh, Scotland, pp. 3140-3142.

Hanna, Review of Energy Variation Approaches in Medical Accelerators, Proceedings of EPAC08, Genoa, Italy, pp. 1797-1799 (Jul. 2008).

Huang et al., Electron gun used in the accelerator for customs inspection systems, Proceedings of the Second Asian Particle Accelerator Conference, Beijing, China, 2001, 3 pages.

Iwashita, Disk-and-Washer LINAC structure with biperiodic T supports, IEEE Transactions on Nuclear Science, vol. NS-30, No. 4, Aug. 1983, pp. 3542-3544.

Jang et al., Perveance monitor for measuring an 80-MW klystron characteristics, Proceedings of APAC 2004.

Kamino et al., Development of a new concept automatic frequency controller for an ultrasmall C-band linear accelerator guide, Med. Phys., vol. 34, issue 8, Aug. 2007, pp. 3243-3248.

Khodak et al., Electron gun for technological linear accelerator, Problems of Atomic Science and Technology (PAST), Ukraine, 2000, No. 2, pp. 86-88.

Miller et al., Comparison of standing-wave and traveling-wave structures, Invited paper presented at the Stanford Linear Accelerator Conference, Stanford, California, Jun. 2-6, 1986, 6 pages.

Nantista et al., Calculating RF profiles for beam loading compensation of arbitrary current profiles, Next Linear Collider (NLC) Note #25, Aug. 1997, 11 pages.

Ogorodnikov et al., Processing of interlaced images in 4-10 MeV dual energy customs system for material recognition, Physical Review Special Topics—Accelerators and Beams, vol. 5, 104701 (2002), 11 pages.

Oki et al., Low output-impedance RF system for beam loading compensation, Research Center for Nuclear Physics (RCNP) Annual Report 2001, Osaka University, Japan, 2 pages.

Tamura et al., Development of high-power X-band semiconductor microwave switch for pulse compression systems of future linear colliders, Physical Review Special Topics—Accelerators and Beams, vol. 5, 062001 (2002), 16 pages.

Karzmark et al., Medical Electron Accelerators, McGraw-Hill, Inc., 1993, pp. 82-87.

Maciszewski et al., Application of Electronica 10-10 Electron Linac for Food Processing, 4th European Particle Accelerator Conference, Jun. 27-Jul. 1, 1994, London, England, pp. 2644-2646.

Pirozhenko, Efficient Traveling-Wave Accelerating Structure for Linear Accelerators, Proceedings of EPAC08, Jun. 23-27, 2008, Genoa, Italy, pp. 2746-2748.

D'Auria et al., a New Electron Gun Modulator for the LINAC, Proceedings of LINAC96, Aug. 1996, pp. 854-856.

Hernandez et al., A 7MeV S-Band 2998MHz Variable Pulse Length Linear Accelerator System, Proceedings of 2005 Particle Accelerometer Conference, Knoxville, Tennessee, pp. 1895-1897.

Purdy et al., Dual energy x-ray beam accelerators in radiation therapy: an overview, Nuclear Instruments and Methods in Physics Research B10/B11, 1985, pp. 1090-1095.

Toma et al., Aspects of the Control System for the Electron Linear Accelerators Built in Romania, International Conference on Accelerator and Large Experimental Physics Control Systems, 1999, Trieste, Italy, pp. 654-656.

International Search Report for PCT/US2011/054263, 4 pages, mailed Jan. 6, 2012.

Written Opinion of the International Searching Authority for PCT/US2011/054263, 8 pages, mailed Jan. 6, 2012.

USPTO Non-Final Office Action for U.S. Appl. No. 12/499,644, mailed Nov. 15, 2011, 11 pages.

(56) References Cited

OTHER PUBLICATIONS

USPTO Non-Final Office Action for U.S. Appl. No. 12/581,086, mailed Nov. 8, 2011, 6 pages.
USPTO Non-Final Office Action for U.S. Appl. No. 12/697,031, mailed Dec. 22, 2011, 18 pages.
USPTO Non-Final Office Action for U.S. Appl. No. 12/976,810, mailed Mar. 20, 2014.
USPTO Final Office Action for U.S. Appl. No. 12/976,810, mailed Aug. 13, 2013.
USPTO Non-Final Office Action for U.S. Appl. No. 12/976,810, mailed Jan. 17, 2013.
USPTO Non-Final Office Action for U.S. Appl. No. 12/976,787, mailed Mar. 4, 2013, 36 pages.
USPTO Non-Final Office Action for U.S. Appl. No. 12/976,787, mailed Jan. 15, 2014, 22 pages.

* cited by examiner

SYSTEMS AND METHODS FOR CARGO SCANNING AND RADIOTHERAPY USING A TRAVELING WAVE LINEAR ACCELERATOR BASED X-RAY SOURCE USING PULSE WIDTH TO MODULATE PULSE-TO-PULSE DOSAGE

1. CROSS-REFERENCE TO RELATED APPLICATIONS

This application is a continuation-in-part of U.S. patent application Ser. No. 12/976,787, filed Dec. 22, 2010 and entitled "Traveling Wave Linear Accelerator Based X-Ray Source Using Pulse Width to Modulate Pulse-to-Pulse Dosage," which claims the benefit of U.S. Provisional Application No. 61/389,149, filed Oct. 1, 2010, the entire content of which is incorporated herein by reference.

2. TECHNICAL FIELD

The invention relates to systems and methods for use in cargo scanning and radiotherapy based on generating x-rays with modulated pulse-to-pulse dosage using a traveling wave linear accelerator by varying pulse width.

3. BACKGROUND OF THE INVENTION

Linear accelerators (LINACs) are useful tools for industrial applications, such as radiography, cargo inspection and food sterilization, and medical applications, such as radiation therapy and imaging. In some of these applications, beams of electrons accelerated by the LINAC are directed at the sample or object of interest for analysis or for performing a procedure. However, in many of these applications, it can be preferable to use x-rays to perform the analysis or procedure. These x-rays may be generated by directing the electron beams from the LINAC at an x-ray emitting target.

A cargo inspection device that uses x-rays generated from a LINAC is useful during non-intrusive inspection of cargo because of the high energy output (and therefore greater penetration) that it provides. As a result, large quantities of containers may inspected more accurately without requiring inspectors to open the containers.

Typically, the LINACs used in cargo inspection systems are configured to produce a single energy x-ray beam. A detector receives the single energy x-ray beam that has penetrated the shipping container without being absorbed or scattered, and produces an image of the contents of the shipping container. The image may be displayed to an inspector who can perform visual inspection of the contents. The inspector may observe contents in the container that require further analysis. It has been suggested to vary the x-ray dosage, i.e., intensity, to further inspect dense cargo. It would be desirable to provide a LINAC based x-ray source configured to modulate pulse-to-pulse intensity while outputting energy stable electron beams from the LINAC.

Other previously-known cargo inspection devices use dual energy LINACs that are configured to emit two different energy level x-ray beams. With a dual energy x-ray inspection system, materials can be discriminated radiographically by alternately irradiating an object with x-ray beams of two different energies. Dual energy x-ray inspection systems can determine a material's mass absorption coefficient, and therefore the effective atomic (Z) number of the material. Differentiation is achieved by comparing the attenuation ratio obtained from irradiating the container with low-energy x-rays to the attenuation ratio obtained from irradiating the container with high-energy x-rays. Discrimination is possible because different materials have different degrees of attenuation for high-energy x-rays and low-energy x-rays, and that allows identification of low-Z-number materials (such as but not limited to organic materials), medium-Z-number materials (such as but not limited to transition metals), and high-Z-number materials (such as but not limited to radioactive materials) in the container. Such systems can therefore provide an image of the cargo contents and identify the materials that comprise the cargo contents.

The ability of dual energy x-ray inspection systems to detect the Z number of materials being scanned enables such inspection systems to automatically detect the different materials in a container, including radioactive materials and contraband such as but not limited to cocaine and marijuana. However, conventional dual energy x-ray inspection systems use a standing wave LINAC that is vulnerable to frequency and power jitter and temperature fluctuations, causing the beam energy from the linear accelerator to be unstable when operated to accelerate electrons to a low energy. The energy jitter and fluctuations can create image artifacts, which cause an improper Z number of a scanned material to be identified. This can cause false positives (in which a targeted material is identified even though no targeted material is present) and false negatives (in which a targeted material is not identified even though targeted material is present).

Like single energy x-ray inspection systems, dual energy x-ray inspection systems may produce an image of the contents of a shipping container that may be displayed to an inspector who can perform visual inspection of the contents. The inspector may observe contents in the container that require further analysis. Accordingly, it would be desirable to provide a dual energy LINAC based x-ray inspection system configured to modulate pulse-to-pulse intensity to increase an inspector's ability to accurately investigate cargo.

Radiotherapy applications also may employ single or dual energy x-rays in irradiating a tumor volume so as to cause necrosis of the volume. It would be desirable to modulate pulse-to-pulse intensity to enhance the treating physician's ability to more homogeneously irradiate the tumor volume.

4. SUMMARY OF THE INVENTION

The present invention provides a traveling wave linear accelerator (TW LINAC) based x-ray source configured to modulate pulse-to-pulse intensity while outputting energy stable electron beams of varying energies. The TW LINAC may be configured for use in both cargo scanning and radiotherapy applications.

The TW LINAC of the present invention includes an electron gun modulator configured to adjust a pulse width and a beam injection time of a beam of electrons from an electron gun, and a frequency/power controller configured to determine a frequency and a power of a radio frequency (RF) signal to be generated. The TW LINAC further includes an intensity controller operatively associated with the electron gun modulator and the frequency/power controller. The intensity controller is configured to receive a plurality of intensity/energy adjustment commands and to respectively determine a pulse width, a beam injection time, an RF power factor, and a frequency adjustment factor based on each energy/intensity adjustment command to provide a respective output dose rate and energy of electrons. For each intensity/energy adjustment command, the intensity controller transmits the determined pulse width and the determined beam injection time to the electron gun modulator so that the modulator commands an electron gun to adjust the outputted pulse width and beam injection timing of electrons and the frequency/power controller receives the frequency adjustment factor and the RF power factor and adjusts the frequency and power of the RF signal such that the traveling wave linear accelerator generates electrons having the respective output dose rate and energy.

In embodiments suitable for use in cargo scanning applications, the traveling wave linear accelerator further includes an x-ray target configured to generate x-rays responsive to irradiation with electrons, the x-rays irradiating a cargo container; and a detector configured to detect x-rays transmitted through the container. A control unit may be operatively associated with the detector and with the intensity controller. The control unit may be configured to send a first intensity adjustment command to cause the intensity controller to determine a first pulse width, a first beam injection time, a first RF power factor, and a first frequency adjustment factor to provide a first output dose rate and first energy of a first set of electrons. The control unit further may be configured to determine a percent transmission of a first set of x-rays through the container based on an output of the detector, the first set of x-rays being generated by the first set of electrons. The control unit also may be configured to send a second intensity/energy adjustment command to cause the intensity controller to determine a second pulse width, a second beam injection time, a second RF power factor, and a second frequency adjustment factor to provide a second output dose rate and second energy of a second set of electrons, for example if the percent transmission is below a predetermined threshold.

The second energy may be higher than the first energy. The intensity controller may be configured to select the second output dose rate of the second set of electrons such that a dose of the second set of x-rays generated by the second set of electrons is about the same as that of the first set of x-rays.

The control unit may be configured to determine a percent transmission of a second set of x-rays through the container based on an output of the detector, the second set of x-rays being generated by the second set of electrons; and, if the percent transmission is below a predetermined threshold, to send a third intensity/energy adjustment command to cause the intensity controller to determine a third pulse width, a third beam injection time, a third RF power factor, and a third frequency adjustment factor to provide a third output dose rate and third energy of a third set of electrons. The third energy may be higher than the second energy. The intensity controller may be configured to select the third output dose rate of the third set of electrons such that a dose of a third set of x-rays generated by the third set of electrons is about the same as that of the second set of x-rays. Alternatively, the third energy may be lower than the second energy and the intensity controller may be configured to select the third output dose rate of the third set of electrons such that a dose of the third set of x-rays is greater than a dose of a first set of x-rays generated by the first set of electrons.

Some embodiments may include a control unit operatively associated with the detector and with the intensity controller, the control unit being configured to send a first intensity/energy adjustment command to cause the intensity controller to determine a first pulse width, a first beam injection time, a first RF power factor, and a first frequency adjustment factor to provide a first output dose rate and first energy of a first set of electrons. The control unit further may be configured to determine a percent transmission of a first set of x-rays through the container based on an output of the detector, the first set of x-rays being generated by the first set of electrons. The control unit also may be configured such that if the percent transmission is above a predetermined threshold, the control unit sends a second intensity/energy adjustment command to cause the intensity controller to determine a second pulse width, a second beam injection time, a second RF power factor, and a second frequency adjustment factor to provide a second output dose rate and second energy of a second set of electrons. The intensity controller also may be configured to select the second output dose rate of the second set of electrons such that a dose of a second set of x-rays generated by the second set of electrons is less than the dose of the first set of x-rays.

In alternative embodiments in which the traveling wave linear accelerator is configured for radiotherapy applications, the traveling wave linear accelerator may further include an x-ray target configured to generate x-rays responsive to irradiation with electrons from the traveling wave linear accelerator, the x-rays being configured to irradiate a tumor volume; and a robotic arm on which the x-ray target and the linear accelerator are mounted and configured to adjust an angle at which the x-rays irradiate the tumor volume.

The traveling wave linear accelerator may also include a control unit operatively associated with the robotic arm and with the intensity controller. The control unit may be configured to send a first intensity/energy adjustment command to cause the intensity controller to determine a first pulse width, a first beam injection time, a first RF power factor, and a first frequency adjustment factor to provide a first output dose rate and a first energy of a first set of electrons, as well as a first position command to the robotic arm to cause the robotic arm to adjust the angle to irradiate a first portion of the tumor volume with x-rays generated by the first set of electrons. The control unit further may be configured to send a second intensity/energy adjustment command to cause the intensity controller to determine a second pulse width, a second beam injection time, a second RF power factor, and a second frequency adjustment factor to provide a second output dose rate and a second energy of a second set of electrons; as well as to send a second position command to the robotic arm to cause the robotic arm to adjust the angle to irradiate a second portion of the tumor volume with x-rays generated by the second set of electrons.

The second energy may be higher than the first energy. The second tumor volume may be deeper than the first tissue volume. The first tissue volume and the second tissue volume may receive about the same doses of x-rays as one another.

Under another aspect of the present invention, a method is provided for generating a plurality of dose rates and energies of electrons using a traveling wave linear accelerator that includes an electron gun modulator configured to adjust a beam current of electrons from an electron gun and a frequency/power controller configured to adjust a frequency and a power of a radio frequency (RF) signal to be generated. The method may include receiving at an intensity controller a plurality of intensity/energy adjustment commands and respectively determining a pulse width, a beam injection time, an RF power factor, and a frequency adjustment factor based on each intensity/energy adjustment command to provide a respective dose rate and energy of electrons. For each intensity/energy adjustment command, the method may also include adjusting the pulse width and beam injection time of electrons from the electron gun at the electron gun modulator using the determined pulse width and the determined beam injection time; determining the frequency and power of the RF signal to be generated at the frequency/power controller using the frequency adjustment factor and the RF power factor; and generating electrons having the respective output dose rate and energy using the traveling wave linear accelerator.

In embodiments where the traveling wave linear accelerator is used for cargo scanning applications, the method may include sending a first intensity/energy adjustment command to cause the intensity controller to determine a first pulse width, a first beam injection time, a first RF power factor, and a first frequency adjustment factor to provide a first output dose rate and first energy of a first set of electrons; generating x-rays with the first set of electrons; and irradiating a cargo container with the x-rays. The method also may include determining a percent transmission of a first set of x-rays through the container based on an output of the detector. If the percent transmission is below a predetermined threshold, the method may include sending a second intensity/energy adjustment command to cause the intensity controller to determine a second pulse width, a second beam injection time, a second RF power factor, and a second frequency adjustment factor to provide a second output dose rate and second energy of a second set of electrons.

In embodiments where the traveling wave linear accelerator is used for radiotherapy applications, the method may include sending a first intensity/energy adjustment command to cause the intensity controller to determine a first pulse width, a first beam injection time, a first RF power factor, and a first frequency adjustment factor to provide a first output dose rate and a first energy of a first set of electrons; and sending a first position command to a robotic arm on which the linear accelerator and an x-ray target are mounted to cause the robotic arm to adjust an angle to irradiate a first portion of a tumor volume with x-rays generated by the first set of electrons. The method also may include sending a second intensity/energy adjustment command to cause the intensity controller to determine a second pulse width, a second beam injection time, a second RF power factor, and a second frequency adjustment factor to provide a second output dose rate and a second energy of a second set of electrons; and sending a second position command to the robotic arm to cause the robotic arm to adjust the angle to irradiate a second portion of the tumor volume with x-rays generated by the second set of electrons.

5. BRIEF DESCRIPTION OF THE DRAWINGS

The present invention is illustrated by way of example, and not by way of limitation, in the figures of the accompanying drawings.

6. DETAILED DESCRIPTION

The present disclosure relates to systems and methods for use in generating x-rays with modulated pulse-to-pulse dosage, i.e., intensity, using a traveling wave linear accelerator (TW LINAC), particularly for use in cargo scanning and radiotherapy applications.

In an exemplary TW LINAC, electrons injected into an accelerator structure of the TW LINAC by an electron gun are accelerated and focused along the accelerator structure using the electric and magnetic field components of an electromagnetic wave that is coupled into the accelerator structure. The electromagnetic wave may be coupled into the accelerator structure from an electromagnetic wave source, such as a klystron or magnetron. As the electrons traverse the accelerator structure, they are focused and accelerated by forces exerted on the electrons by the electric and magnetic field components of the electromagnetic wave to produce a high-energy electron beam. The electron beam from accelerator structure may be directed at an x-ray emitting target to generate x-rays.

Provided herein are systems and methods for operating a TW LINAC to generate energy stable electron beams at two or more different intensities by varying the number of electrons injected into the accelerator structure during each pulse by, for example, varying the width of the beam pulse, i.e., pulse width. As discussed further below, in certain embodiments, concomitant with the electron pulse width adjustment, adjustments of the injection timing of electron beams on a pulse-to-pulse basis can advantageously generate electron beams having substantially the same energy from pulse-to-pulse with varied intensities in a single energy operation. In a single energy operation, "pulse-to-pulse" means from one pulse to a subsequent pulse.

Advantageously, systems and methods provided herein generate energy stable electron beams with varied intensities using varied pulse width, even in a transient beam loading regime.

Also provided herein are systems and methods for operating a TW LINAC to generate energy stable electron beams at two or more different energies, i.e., an interleaving operation, and at many different intensities by varying the number of electrons injected into the accelerator structure during each pulse by, for example, varying the pulse width. As discussed further below, in certain embodiments, concomitant with the pulse width adjustment, adjustments of the injection timing of electron beams on a pulse-to-pulse basis can advantageously generate electron beams having substantially the same energy from pulse-to-pulse with varied intensities in a step intensity operation. In an interleaving energy operation, "pulse-to-pulse" means from one pulse to the next subsequent pulse having substantially the same energy.

Figure 1A:
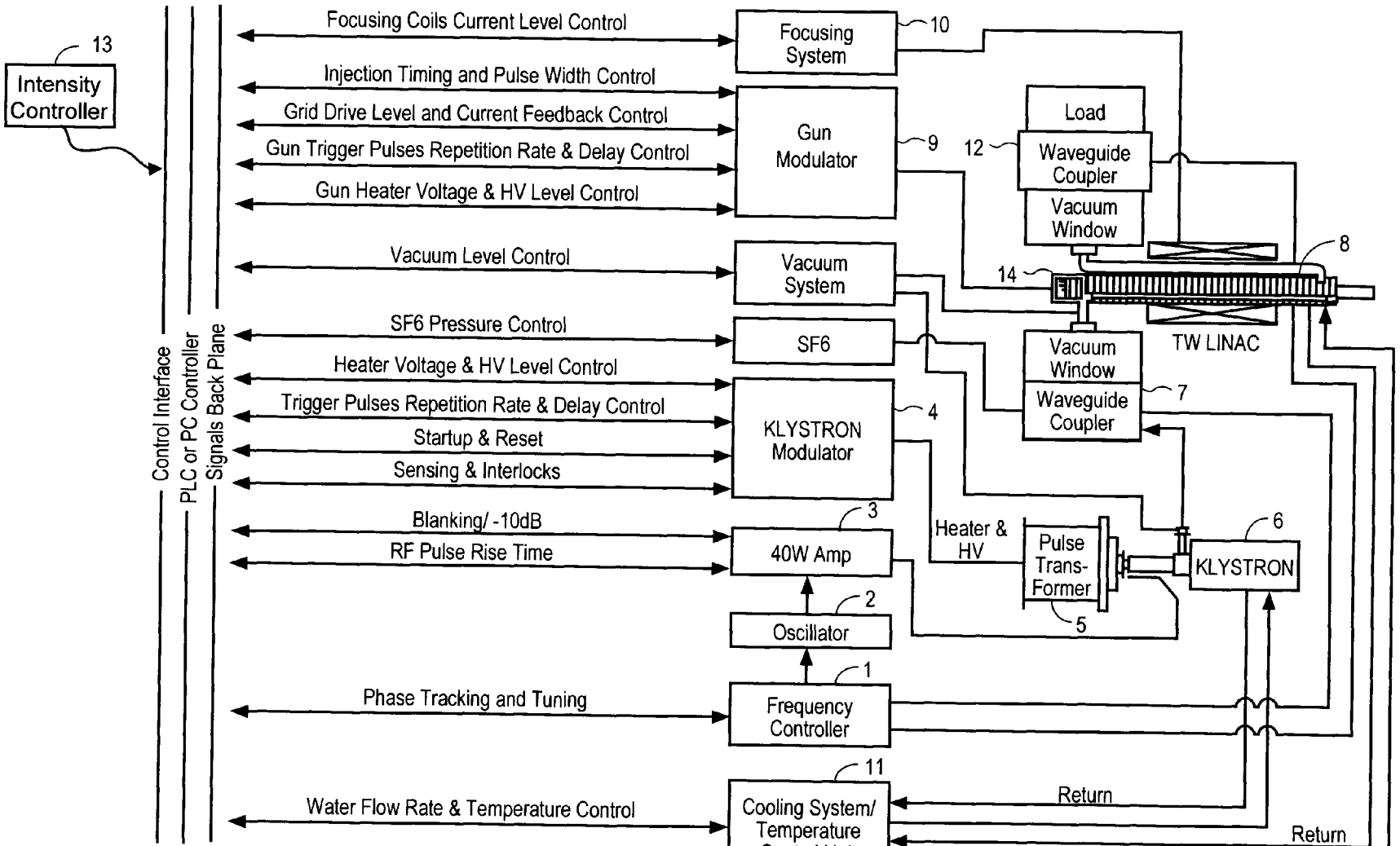
FIG. 1A illustrates a block diagram of a multi-energy traveling wave linear accelerator (TW LINAC) including a klystron.
Figure 1B:
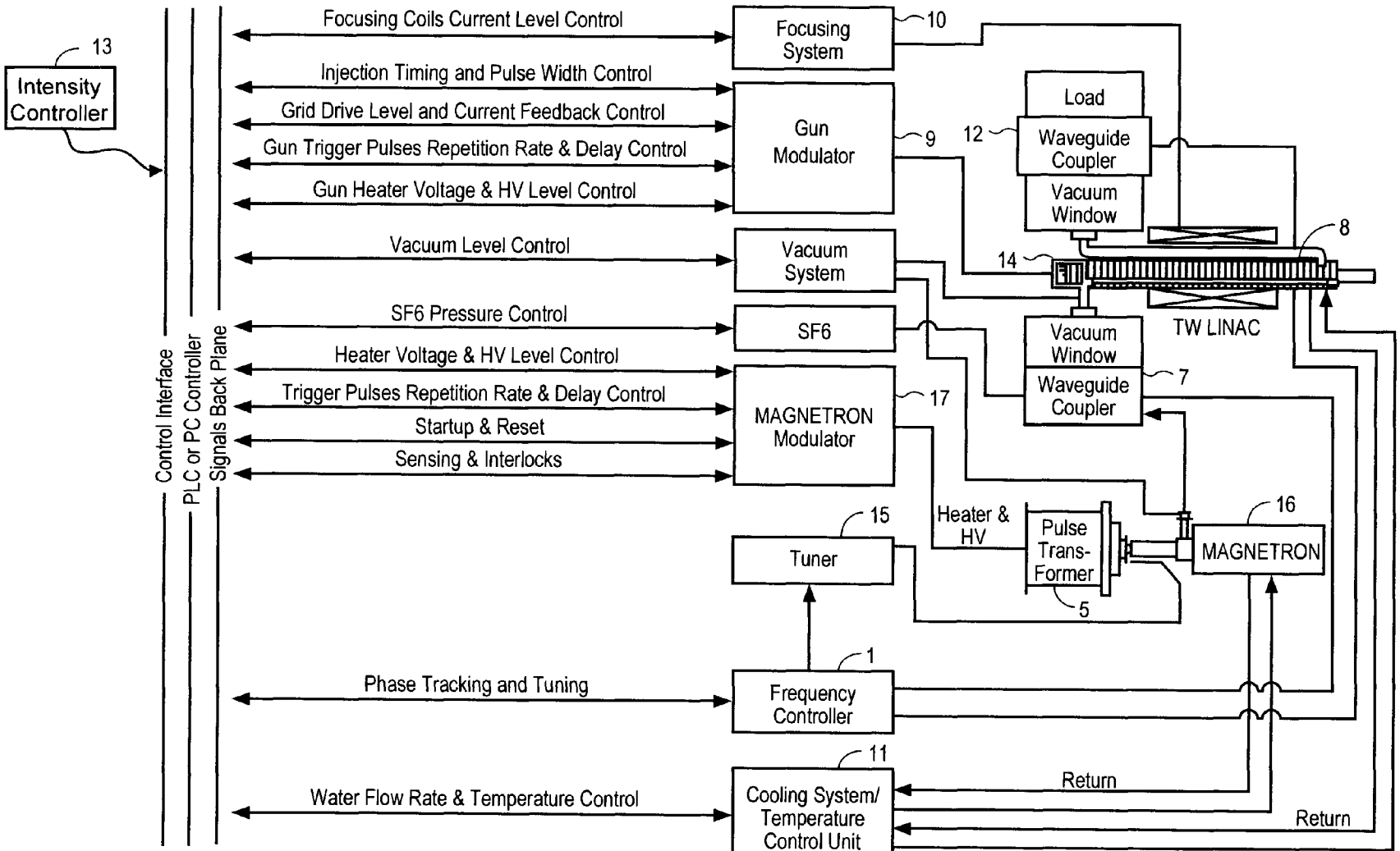
FIG. 1B illustrates a block diagram of a multi-energy TW LINAC including a magnetron.

The electromagnetic wave source in the TW LINAC may be any suitable radio frequency (RF) source. Non-limiting examples of the electromagnetic wave source include a klystron, as illustrated in FIG. 1A, and a magnetron, as illustrated in FIG. 1B. Since a magnetron is an oscillator, it can be less agile with respect to frequency tuning or power level of operation than a klystron (an amplifier for which both frequency and output power can be tuned using a low power external driver). That is, it can be more difficult to modify the frequency or power level of a magnetron than a klystron. In certain embodiments, the system and method need not use the magnetron to vary the frequency or power level of an electromagnetic wave. The system and method may advantageously facilitate different energy outputs of the TW LINAC substantially without modification to the frequency or power level of the magnetron.

For accelerators that are configured to generate multiple different energies, the accelerator should be separately tuned at each of the energy levels to provide maximum efficiency at the highest energy level, and to maximize stability at each energy level. The following sections describe a traveling wave linear accelerator (TW LINAC) that can be tuned at multiple different energy levels to provide a highly stable, highly efficient x-ray beam. An electromagnetic wave is also referred to herein as a carrier wave. The electromagnetic waves (i.e., carrier waves) accelerate electron bunches within an accelerator structure to generate an x-ray beam. Changing the beam injection timing enables the electron bunches to be centered on the desired energy even when the pulse width applied to the electron gun is varied to times relatively short as compared with the filling time of the structure. Optimizing the frequency with the frequency controller for the operating energy or energies can reduce susceptibility of the TW LINAC to jitter of the amplitude and frequency of the RF electromagnetic waves, jitter of the electron gun at high voltage and temperature fluctuations of the accelerator structure, and can maximize efficiency at each energy level.

6.1 Multi-Energy Traveling Wave Linear Accelerator Architecture

FIG. 1A illustrates a block diagram of an exemplary multi-energy traveling wave linear accelerator including a klystron, in accordance with one embodiment of the present invention. The illustrated traveling wave linear accelerator (TW LINAC) includes a control interface, frequency controller 1, oscillator 2, amplifier 3, klystron modulator 4, pulse transformer 5, klystron 6, waveguides 7 and 12, accelerator structure 8, gun modulator 9, focusing system 10, cooling system 11, intensity controller 13, and electron gun 14.

The control interface, frequency controller 1, oscillator 2, amplifier 3, klystron modulator 4, pulse transformer 5, klystron 6, waveguides 7 and 12, accelerator structure 8, focusing system 10, and cooling system 11 may include the features hereinafter described, but otherwise may be conventional.

In accordance with the principles of the present invention, intensity controller 13 may be configured to receive a command to adjust the intensity of the electron beams output from the TW LINAC thereby adjusting the intensity of x-rays generated by directing the electron beams at an x-ray emitting target. In one embodiment, the command may be from a user adjusting a user input device such as a knob, button, switch, keypad or the like. The intensity controller 13 may be a PLC and/or PC external to the multi-energy TW LINAC as illustrated. The intensity controller 13 may be configured to communicate with the PLC or PC controller. In another embodiment, the intensity controller 13 may be integrated into the PLC or PC controller of the multi-energy TW LINAC.

The intensity controller 13 may be further configured to determine the pulse width and beam injection timing. In one embodiment, the intensity controller 13 may store predetermined pulse widths and beam injection timings. Upon receipt of an adjusted intensity command, the intensity controller 13 may determine a suitable pulse width and beam injection timing using, for example, a lookup table and/or suitable computer software for interpolation. The determined pulse width and beam injection timing may be transmitted by the signal backplane to the gun modulator 9 such that the gun modulator 9 can change the pulse width and beam injection timing on a pulse-to-pulse basis.

The pulse width may scale roughly with the desired intensity for each energy. Pulse widths may be determined experimentally for each desired intensity and stored in the lookup table. Pulse widths may also be interpolated based on the change in intensity using suitable computer software known to one of ordinary skill in the art.

The beam injection timing may be determined such that the transient energy of the pulse is centered around the steady state energy. Advantageously, electron beams generated with varied intensities using varied pulse width at such beam injection timing may be stable, even in the transient beam loading regime. Transient refers to the duration near or less than about two times the filling time of the TW LINAC. In an example, the filling time may be about 220 nanoseconds in an X-band TW LINAC. When beam pulses are shorter than the TW LINAC filling time, the spectrum quality of the beam may be poor. However, adjusting the beam injection timing such that the transient energy of the pulse is centered around the steady state energy may provide high quality electron beams with substantially the same energy from pulse-to-pulse. Such beam injection timing may be calculated for a beam with the length of one filling time or longer as follows:

$$t_{inj} = -\left(\frac{Q}{\omega}\right)\ln\left[e^{-2\tau} + \frac{ri_0}{2E_0}(1 - e^{-2\tau} - 2\tau e^{-2\tau})\right]$$

where $t_{inj}$ is the beam injection timing, $i_0$ is current in a constant gradient traveling wave accelerator, $\tau$ is attenuation factor, $E_0$ is accelerating gradient, r is shunt impedance, Q is quality factor, and $\omega$ is RF angular frequency. For a beam length less than the filling time, the beam injection time may be adjusted based on the best optimized energy spectrum, which may be centered with the steady state energy gain.

Figure 1C:
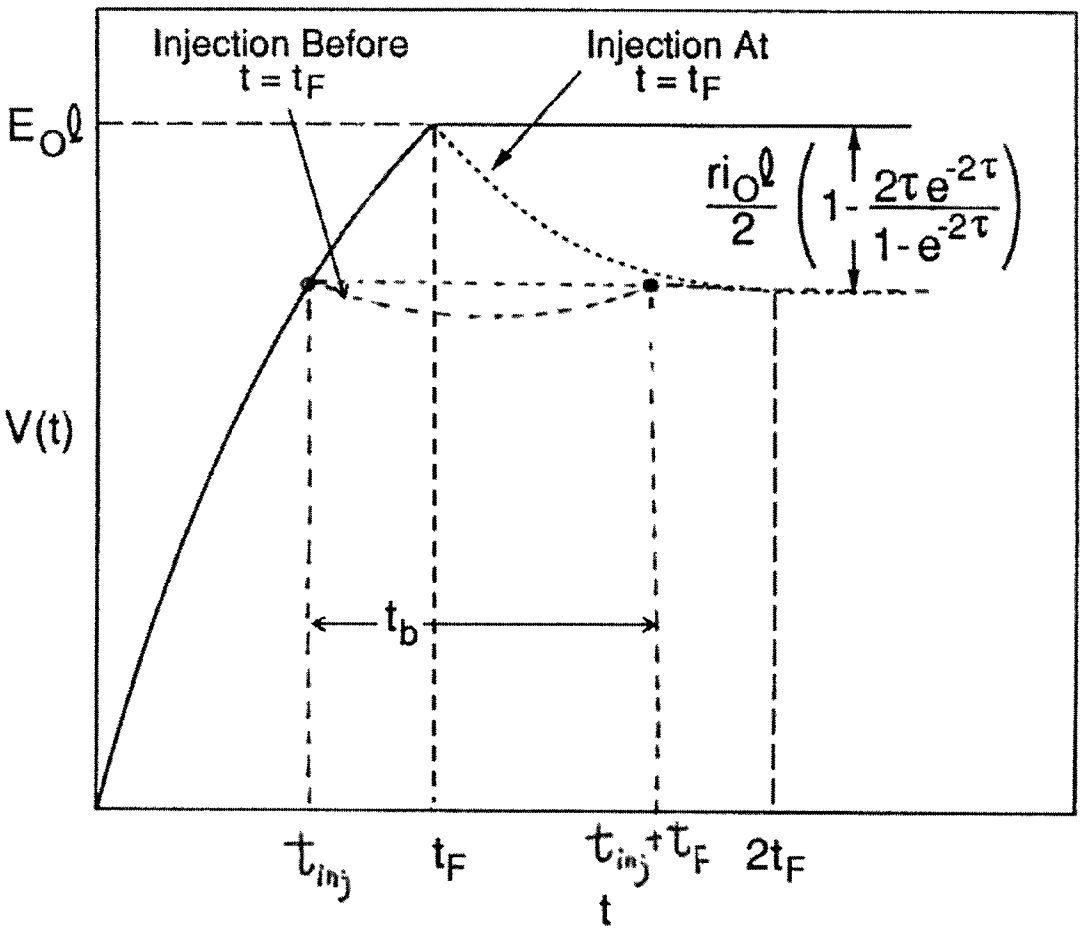
FIG. 1C is a plot showing the energy gain of an electron beam with current $i_o$ in a constant gradient TW LINAC.

FIG. 1C is a plot showing the energy gain of an electron beam with current $i_o$ in a constant gradient TW LINAC. In the Figure, $t_b$ is the total length of the beam in time, $t_F$ is filling time, $t_i$ is the start time of the beam, and l is length. As seen in the Figure, the exemplary beam injection timing may be determined such that the transient energy of the pulse is centered around the steady state energy.

Beam injection timings may be determined experimentally for each desired intensity and stored in the lookup table. Beam injection timings may also be interpolated based on the change in intensity using suitable computer software known to one of ordinary skill in the art.

In embodiments where the TW LINAC includes a magnetron (discussed below with reference to FIG. 1B), the beam injection time may be based on the rise time of the RF pulse set on the magnetron. In other embodiments where the TW LINAC includes a klystron, the rise time of the RF pulse may be adjusted such that the fields in the LINAC are very similar to steady state beam-loaded fields when the beam is first injected. Appropriate choice of the RF rise time combined with the appropriate beam injection timing of the gun pulse, determined as described herein, can reduce or even eliminate the energy transient associated with beam loading. Advantageously, selecting proper RF rise time and beam injection time allows x-ray intensity to be changed without changing x-ray energy. The optimum rise time of an RF pulse depends on the beam current which changes for different energies, but not for different intensities when the intensity is adjusting by changing pulse length. For example, a rise time may be determined for an RF source by adjusting the rise time and observing the energy spectrum of the resulting beam on an energy analyzer instrument, such as a bending magnet energy analyzer.

The beam current may be held constant for single energy LINAC operations. For interleaving operations, the beam current may be held constant from pulse-to-pulse and may vary for different output energies. Beam currents may be calculated or determined experimentally for each desired energy and stored in the lookup table.

The frequency does not change for a change in intensity, but changes for a change in energy.

The intensity controller 13 may include a computer readable medium including instructions that, when executed by a processor, cause the processor to determine and transmit the pulse width and the beam injection time as discussed above. Non-limiting examples of a computer readable medium include a floppy disk, a hard disk, a memory, RAM, ROM, a compact disk, a digital video disk, and the like. The computer readable medium may be further configured to adjust the pulse width and beam injection time of electrons from an electron gun 14 using the determined pulse width and the determined beam injection time. The TW LINAC may then generate an output dose rate of electrons.

In some embodiments, the intensity controller 13 may include and may execute a programmed routine configured to receive an intensity adjustment command and to determine the pulse width and the beam injection time as discussed above.

Through the control interface, a user can adjust settings, control operation, etc. of the TW LINAC. The control interface communicates with a programmable logic controller (PLC) and/or a personal computer (PC) that is connected to a signal backplane. The PLC and/or PC may include the computer readable medium and/or the processor and may execute the programmed routine discussed above. The signal backplane provides control signals to multiple different components of the TW LINAC based on instructions received from the PLC, PC and/or control interface.

A frequency controller 1 receives phase tracking and tuning control information from the signal backplane. The frequency controller 1 can be configured to operate at a single frequency setting or to alternate between two or more different frequency settings. For example, the frequency controller 1 can be configured to alternate between a frequency of 9290 MHz and a frequency of 9291 MHz, 400 times per second. Alternatively, the frequency controller 1 may be configured to alternate between more than two different frequencies. In an example, based on the comparison of the measured phase shift of the electromagnetic wave through the TW LINAC on the previous pulse of the same energy with the set point for energy of the next pulse, the frequency controller 1 adjusts settings of an oscillator 2. By modifying the frequency of the RF signal generated by the oscillator 2, the frequency controller 1 can change the frequency of electromagnetic waves (carrier waves) produced by a klystron 6 on a pulse by pulse basis. Frequency shifts on the order of one or a few parts in 10,000 can be achieved.

The frequency controller 1 may be a phase detection frequency controller, and can use phase vs. frequency response to establish a correct frequency setting. The frequency controller 1, by monitoring and correcting the phase shift from the input to the output of the accelerator, can correct for medium and slow drifts in either the RF frequency or the temperature of the accelerator structure 8. The frequency controller 1 can operate as an automatic frequency control (AFC) system. In an example, the frequency controller 1 can be a multi-frequency controller, and can operate at a set point for each of several different frequencies, with each frequency being associated with each different energy. The frequency controller, including the AFC, is discussed further in Section 6.3 below.

The oscillator 2 generates an RF signal having a frequency that is provided by the frequency controller 1. The oscillator 2 is a stable low level tunable RF source that can shift in frequency rapidly (e.g., between pulses generated by the klystron modulator 4). The oscillator 2 can generate an RF signal at the milliwatt level. The RF signal is amplified by an amplifier 3 (e.g., a 40 Watt amplifier), and supplied to a klystron 6.

The amplifier 3 can be a solid state amplifier or a traveling wave tube (TWT) amplifier, and can amplify the received RF signal to a level required for input to the klystron 6. The amplifier 3 may be configured to receive RF pulse rise time information from the signal backplane as determined by the intensity controller 13. In an example, the amplifier 3 can be configured to change the output power level, on a pulse to pulse basis, to the level appropriate for the energy of an upcoming LINAC pulse. Alternatively, the klystron modulator 4 could deliver different high voltage pulses to the klystron 6 for each beam energy required.

A klystron modulator 4 receives heater and high voltage (HV) level control, trigger pulse and delay control, startup and reset, and sensing and interlock signals from the signal backplane. The klystron modulator 4 is a capable of generating high peak power pulses to a pulse transformer. The effective output power of the klystron modulator 4 is the power of the flat-top portion of the high voltage output pulse. The klystron modulator 4 can be configured to generate a new pulse at each frequency change in the frequency controller 1. For example, a first pulse may be generated when the frequency controller 1 causes the oscillator 2 to generate an RF signal having a first frequency, a second pulse may be generated when the frequency controller 1 causes the oscillator 2 to generate an RF signal having a second frequency, a third pulse may be generated when the frequency controller 1 causes the oscillator 2 to generate an RF signal having the first frequency, and so on.

The klystron modulator 4 drives energy into a pulse transformer 5 in the form of repeated high energy approximately square wave pulses. The pulse transformer 5 increases the received pulses into higher voltage pulses with a medium to high step-up ratio. The transformed pulses are applied to the klystron 6 for the generation of high energy microwave pulses. The rise time of the output pulse of the klystron modulator 4 is dominated by the rise time of the pulse transformer 5, and therefore the pulse transformer 5 is configured to have a fast rise time to approximate square waves.

The klystron 6 is a linear-beam vacuum tube that generates high power electromagnetic waves (carrier waves) based on the received modulator pulses and the received oscillator radio frequency (RF) signal. The klystron 6 provides the driving force that powers the linear accelerator. The klystron 6 coherently amplifies the input RF signal to output high power electromagnetic waves that have precisely controlled amplitude, frequency and input to output phase in the TW LINAC accelerator structure. The klystron 6 operates under pulsed conditions, which enables the klystron 6 to function using a smaller power source and require less cooling as compared to a continuous power device. The klystron 6 typically has a frequency band width on the order of one percent or more.

The klystron 6 is a high-gain amplifier, therefore, the output RF signal generated by the klystron 6 has the same frequency as the low power RF signal input to the klystron 6. Thus, changing the frequency of the high power RF electromagnetic wave used to drive the LINAC can be achieved simply by changing the frequency of the low power RF signal used to drive the klystron 6. This can be easily performed between pulses with low power solid state electronics. Similarly, the output power of the electromagnetic wave from the klystron can be changed from pulse to pulse by just changing the power out of the amplifier 3. Moreover, the rise time of the klystron output pulse can be determined by the rise time of the low power RF pulse used to drive the klystron. This can reduce or even eliminate the beam loading transient experienced in the LINAC.

A waveguide 7 couples the klystron 6 to an input of an accelerator structure 8 of the TW LINAC. The waveguide 7 includes a waveguide coupler and a vacuum window. The waveguide 7 carries high powered electromagnetic waves (carrier waves) generated by the klystron 6 to the accelerator structure 8. The waveguide coupler of waveguide 7 can sample a portion of the electromagnetic wave power to the input of the LINAC. A waveguide 12 that includes a waveguide coupler and a vacuum window couples the output of the accelerator structure 8 to the RF load. The waveguide coupler of waveguide 12 can sample a portion of the electromagnetic wave power from the output of the LINAC. A phase comparator of frequency controller 1 can be used to compare a signal from the waveguide coupler of waveguide 7 to a signal from the waveguide coupler of waveguide 12 to determine the phase shift of the electromagnetic wave through accelerator structure 8. The frequency controller 1 uses the phase shift of the electromagnetic wave to determine the frequency correction to be applied at the klystron, if any. Waveguide 7 or waveguide 12 can be a rectangular or circular metallic pipe that is configured to optimally guide waves in the frequencies that are used to accelerate electrons within the LINAC without significant loss in intensity. The metallic pipe can be a low-Z, high conductivity, material such as copper. To provide the highest field gradient possible with near maximum input power, the waveguide coupler can be filled with $SF_6$ gas. Alternatively, the waveguide can be evacuated.

The vacuum window permits the high power electromagnetic waves to enter the accelerator structure 8 while separating the evacuated interior of the accelerator structure 8 from its gas filled or evacuated exterior.

A gun modulator 9 controls an electron gun 14 that fires electrons into the accelerator structure 8. The gun modulator 9 receives grid drive level and current feedback control signal information from the signal backplane. The gun modulator 9 further receives gun trigger pulses and delay control pulse and gun heater voltage and HV level control from the signal backplane. The gun modulator 9 controls the electron gun 14 by instructing it when and how to fire (e.g., including repetition rate and grid drive level to use). The gun modulator 9 can cause the electron gun 14 to fire the electrons at a pulse repetition rate that corresponds to the pulse repetition rate of the high power electromagnetic waves (carrier waves) supplied by the klystron 6. The gun modulator 9 is operatively associated with the intensity controller 13. Preferably, the gun modulator 9 causes the electron gun 14 to fire the electrons at a pulse width(s) and beam injection time(s) determined by the intensity controller 13.

An exemplary electron gun includes an anode, a grid, a cathode and a filament. The filament is heated to cause the cathode to release electrons, which are accelerated away from the cathode and towards the anode at high speed. The anode can focus the stream of emitted electrons into a beam of a controlled diameter. The grid can be positioned between the anode and the cathode.

The electron gun 14 is followed by a buncher that is located after the electron gun 14 and is typically integral with the accelerating structure. In one embodiment, the buncher is composed of the first few cells of the accelerating structure. The buncher packs the electrons fired by the electron gun 14 into bunches and produces an initial acceleration. Bunching is achieved because the electrons receive more energy from the electromagnetic wave (more acceleration) depending on how near they are to the crest of the electromagnetic wave. Therefore, electrons riding higher on the electromagnetic wave catch up to slower electrons that are riding lower on the electromagnetic wave. The buncher applies the high power electromagnetic waves provided by the klystron 6 to the electron bunch to achieve electron bunching and the initial acceleration.

High power electromagnetic waves are injected into the accelerator structure 8 from the klystron 6 via the waveguide 7. Electrons to be accelerated are injected into the accelerator structure 8 by the electron gun 14. The electrons enter the accelerator structure 8 and are typically bunched in the first few cells of the accelerator structure 8 (which may comprise the buncher). The accelerator structure 8 is a vacuum tube that includes a sequence of tuned cavities separated by irises. The tuned cavities of the accelerator structure 8 are bounded by conducting materials such as copper to keep the RF energy of the high power electromagnetic waves from radiating away from the accelerator structure 8.

The tuned cavities are configured to manage the distribution of electromagnetic fields within the accelerator structure 8 and distribution of the electrons within the electron beam. The high power electromagnetic waves travel at approximately the same speed as the bunched electrons so that the electrons experience an accelerating electric field continuously. In the first portion of the TW LINAC, each successive cavity is longer than its predecessor to account for the increasing particle speed. Typically, after the first dozen or so cells the electrons reach about 98% of the velocity of light and the rest of the cells are all the same length. The basic design criterion is that the phase velocity of the electromagnetic waves matches the particle velocity at the locations of the accelerator structure 8 where acceleration occurs.

Once the electron beam has been accelerated by the accelerator structure 8, it can be directed at a target, such as a tungsten or copper target, that is located at the end of the accelerator structure 8. The bombardment of the target by the electron beam generates a beam of x-rays (discussed in Section 6.4 below). The electrons can be accelerated to different energies before they strike a target. In an interleaving operation, the electrons can be alternately accelerated to two different output energies, e.g., to 6 mega electron volts (MeV)[1] and to 9 MeV. Alternately, the electrons can be accelerated to different energies.

[1] One electron volt equals $1.602\times10^{-19}$ joule. Therefore, 6 MeV=$9.612\times10^{-13}$ joule per electron.

To achieve a light weight and compact size, the TW LINAC may operate in the X-band (e.g., at an RF frequency between 8 GHz and 12.4 GHz). The high operating frequency, relative to a conventional S-band LINAC, reduces the length of the accelerator structure 8 by approximately a factor of three, for a given number of accelerating cavities, with a concomitant reduction in mass and weight. As a result, all of the essential components of the TW LINAC may be packaged in a relatively compact assembly. Alternatively, the TW LINAC may operate in the S-band. Such a TW LINAC requires a larger assembly, but can provide a higher energy x-ray beam (e.g., up to about 18 MeV) with commercially available high power electromagnetic wave sources.

A focusing system 10 controls powerful electromagnets that surround the accelerator structure 8. The focusing system 10 receives a current level control from the signal backplane, and controls a current level of focusing coils to focus an electron beam that travels through the accelerator structure 8. The focusing system 10 is designed to focus the beam to concentrate the electrons to a specified diameter beam that is able to strike a small area of the target. The beam can be focused and aligned by controlling the current that is supplied to the electromagnet. In an example, the focusing current is not changed between pulses, and the current is maintained at a value which allows the electromagnet to substantially focus the beam for each of the different energies of operation.

A sulfur hexafluoride ($SF_6$) controller controls an amount (e.g., at a specified pressure) of $SF_6$ gas that can be pumped into the waveguide. The $SF_6$ controller receives pressure control information from the backplane and uses the received information to control the pressure of $SF_6$ gas that is supplied to the waveguide. $SF_6$ gas is a strong electronegative molecule, giving it an affinity for free electrons. Therefore, the $SF_6$ gas is used as a dielectric gas and insulating material, and can be provided to waveguide 7 and waveguide 12 to quench arcs that might otherwise occur. The $SF_6$ gas increases the amount of peak power that can be transmitted through the waveguide 7, and can increase the voltage rating of the TW LINAC.

A vacuum system (e.g., an ion pump vacuum system) can be used to maintain a vacuum in both the klystron 6 and the accelerator structure 8. A vacuum system also can be used to generate a vacuum in portions of the waveguide 7. In air, intense electric and magnetic fields cause arcing, which destroys the microwaves, and which can damage the klystron, waveguide or accelerator structure. Additionally, within the accelerator structure 8, any beams that collide with air molecules are knocked out of the beam bunch and lost. Evacuating the chambers prevents or minimizes such occurrences.

The vacuum system may report current vacuum levels (pressure) to the signal backplane. If pressure of the klystron 6 or accelerator structure 8 exceed a pressure threshold, the vacuum system may transmit a command to the signal backplane to turn off the klystron 6 until an acceptable vacuum level is reached.

Many components of the TW LINAC can generate heat. Heat can be generated, for example, due to the electromagnetic wave power loss on the inner walls of the accelerator, by the electron bombardment of the target at the end of the accelerator structure 8, and by the klystron 6. Since an increase in temperature causes metal to expand, temperature changes affect the size and shape of cavities within the accelerator structure, the klystron, the waveguide, etc. This can cause the frequency at which the wave is synchronous with the beam to change with the temperature. The proper operation of the accelerator requires careful maintenance of the cavity synchronous frequency to the passage of beam bunches. Therefore, a cooling system 11 is used to maintain a constant temperature and minimize shifts in the synchronous frequency.

The cooling system 11 circulates water or other coolant to regions that need to be cooled, such as the klystron 6 and the accelerator structure 8. Through the signal backplane, the cooling system 11 receives water flow rate and temperature control information. The cooling system 11 can be used to monitor the temperature of the klystron 6 and the accelerator structure 8, and can be configured to maintain a constant temperature in these components. However, the temperature of the metal of the accelerator structure and the klystron may rise as much as 10 degrees when the LINAC is operated at a high repetition rate, which can contribute to the drift in the electromagnetic wave. The frequency controller can be used to compensate for the effect of the drift.

FIG. 1B illustrates a block diagram of an exemplary multi-energy traveling wave linear accelerator including a magnetron, in accordance with one embodiment of the present invention. Many components of FIG. 1B are described above with respect to FIG. 1A. The exemplary multi-energy TW LINAC of FIG. 1B further includes tuner 15, magnetron 16, and magnetron modulator 17 and does not include oscillator 2, amplifier 3, klystron modulator 4, and klystron 6 illustrated in FIG. 1A. Magnetron modulator 17 may operate in substantially the same manner as klystron modulator 4 described above with respect to FIG. 1B. Magnetron modulator 17, tuner 15, and magnetron 16 may include the features hereinafter described, but otherwise may be conventional.

The magnetron 16 may function as a high-power oscillator, to generate electromagnetic waves (usually microwave) pulses of several microseconds duration and with a repetition rate of several hundred pulses per second. The frequency of the electromagnetic waves within each pulse can be typically about 3,000 MHz (S-band) or about 9,000 MHz (X-band). For very high peak beam currents or high average currents, 800 to 1500 MHz (L-band) pulses can be used. The magnetron can be any magnetron deemed suitable by one of skill. For example, the CTL X-band pulsed magnetron, model number PM-1100X (L3 Communications, Applied Technologies, Watsonville, Calif.) can be used.

Typically, the magnetron has a cylindrical construction, having a centrally disposed cathode and an outer anode, with resonant cavities machined out of a solid piece of copper. The space between the centrally disposed cathode and the outer anode can be evacuated. The cathode can be heated by an inner filament; the electrons are generated by thermionic emission. A static magnetic field can be applied perpendicular to the plane of the cross-section of the cavities (for example, perpendicular to a pulsed DC electric field), and a pulsed DC electric field applied between the cathode and the anode. The electrons emitted from the cathode can be accelerated toward the anode by the action of the pulsed DC electric field and under the influence of the magnetic field. Thus, the electrons can be moved in a complex spiraling motion towards the resonant cavities, causing them to radiate electromagnetic radiation at a frequency in the microwave region of the electromagnetic spectrum. The generated microwave pulses can be coupled into to an accelerator structure via a transfer waveguide.

Magnetrons can operate at 1 or 2 MW peak power output to power low-energy LINACs (6 MV or less). Magnetrons can be relatively inexpensive and can be made compact, which can be an advantage for many applications. Continuous-wave magnetron devices can have an output power as high as about 100 kW at 1 GHz with efficiencies of about 75-85 percent, while pulsed devices can operate at about 60-77 percent efficiency. Magnetrons can be used in single-section low energy linear accelerators that may not be sensitive to phase. Feedback systems can be interfaced with the magnetron to stabilize the frequency and power of the electromagnetic wave output.

The frequency controller 1 can be used to maintain the phase shift through the LINAC at the same set point for the different energies of operation of the LINAC. Specifically, the frequency controller 1 can transmit a signal to the tuner 15 to tune the magnetron in order to maintain the phase shift of the electromagnetic wave at the set point. For example, if the measured phase shift of the first electromagnetic wave (generated at a first frequency) is not at the set point, the frequency controller 1 can transmit a signal to the tuner 15 to tune the magnetron to generate a second electromagnetic wave at a modified frequency (i.e., to a second frequency that is not equal to the first frequency) to cause the phase shift of the second electromagnetic wave to be closer to the set point. The first frequency and the second frequency are different if they differ by greater than about 0.001% in magnitude, or more. If the measured phase shift of the first electromagnetic wave (generated at a first frequency) is at the set point, the frequency controller 1 can transmit a signal to the tuner 15 so that the magnetron to generate the second electromagnetic wave at substantially the same frequency as the first electromagnetic wave. For example, the first frequency and the second frequency can be substantially the same frequency if they differ by less than about 0.001%. That is, a measurement of the phase difference between P1 and P2 can cause the magnetron to be tuned to alter its operating frequency, if necessary, and thereby maintain a specific phase shift of the electromagnetic waves through the accelerator structure.

Thus, the signal from the frequency controller 1 to the magnetron can ultimately result in maintaining the phase shift of the electromagnetic waves through the accelerator structure at a set point, based on the magnitude of the phase shift detected by the frequency controller. In a non-limiting example, the frequency controller can be an automatic frequency controller (AFC). The frequency controller may include a controller and a phase comparator as an integral unit. However, in other embodiments, the frequency controller 1 can comprise the controller and phase comparator as separate units.

The frequency of the electromagnetic wave generated by the magnetron can be tuned mechanically. For example, a tuning pin or a tuning slug positioned in communication with the body of the magnetron can be moved in or out of the body of the magnetron to tune its operating frequency. Tuner 15 can include a motor drive that moves the tuning pin or tuning slug to tune the magnetron mechanically. In an embodiment where the magnetron is operated to generate electromagnetic waves at substantially a single frequency (or at values of frequency (f) within a range (δf) around the single frequency), the mechanical tuning can be used to maintain the stability of the performance of the magnetron. For example, δf can be a difference on the order of about one or a few parts in 10,000 of a frequency in kHz. In some embodiments, δf can be a difference on the order of about 0.01 MHz or more. As described in greater detail below, the frequency controller can be used to maintain the stability of the output energy and electron dose stability.

When the TW LINAC is operated at two or more different energies, the magnetron can be tuned to operate at a range of values (δf) around a single frequency (f) that provides for a maximized output of the LINAC at all of the different energies of operation. For example, in an embodiment where the LINAC is operated at 6 MeV and 9 MeV, the magnetron can be operated to generate electromagnetic waves at values within a range (δf) around a single frequency (f) such that the electron bunches are accelerated on average slightly ahead of the peak of the electromagnetic wave during the 9 MeV operation and are accelerated on average slightly behind the peak of the electromagnetic wave during the 6 MeV. In a TW LINAC, the energy can be changed by a significant amount, for example from 9 MeV to 6 MeV, by changing the gun current while only having a small effect on the RF fields in the buncher. The percentage change of the fields in the buncher is much smaller than the 33% reduction in the energy because the beam induced fields which lower the energy are zero at the input end and rise roughly linearly with distance through the LINAC. This means that changing the beam energy in a TW LINAC by changing the beam current should have only a small effect on the phase of the bunch relative to the RF traveling wave in the LINAC.

The single frequency of operation of the magnetron can be determined by first finding an intermediate electron gun current between those used for the two different energies of operation, for which adjusting the frequency of the magnetron to optimize the x-ray yield of the LINAC provides acceptable energy spectrum and stability for both the highest energy operation and the lowest energy. The intermediate electron gun current can be, but is not limited to, an average or median of the highest electron gun current and the lowest electron gun current for a two-energy operation or for operation at three or more different energies. The single frequency of operation of the magnetron, and the range of values (δf) around the single frequency, can be determined as the frequency (and δf) that maximizes a x-ray yield of the LINAC for that intermediate electron gun current. The frequency controller can facilitate stable operation during rapid switching of a multi-energy interleaved operation of the TW LINAC. The frequency controller can be used to correct for the effect of rapid thermalization of the TW LINAC accelerator structure when the system is stepping from standby to full power, drifts in the temperature of the accelerator structure cooling water, or drifts in the frequency of the magnetron.

Figure 2:
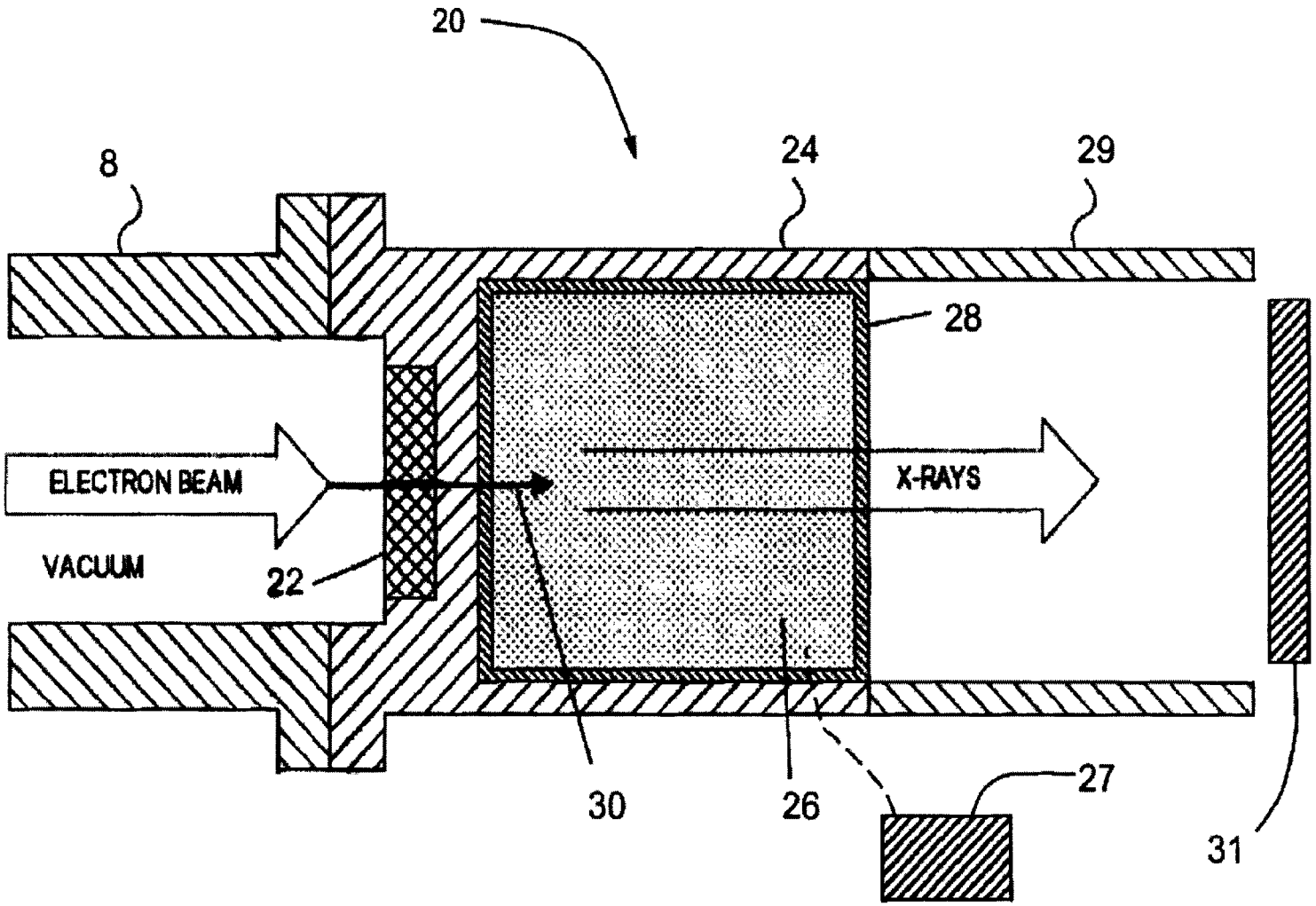
FIG. 2 illustrates a cross-section of a target structure coupled to the accelerator structure.

FIG. 2 illustrates a cross-section of a target structure 20 coupled to the accelerator structure 8 (partially shown). The target structure 20 includes a target 22 to perform the principal conversion of electron energy to x-rays. The target 22 may include a low-Z material such as but not limited to copper, which can avoid or minimize generation of neutrons when bombarded by the output electrons. Additionally, the target may be, for example, an alloy of tungsten and rhenium, where the tungsten is the principle source of x-rays and the rhenium provides thermal and electrical conductivity. The target 22 may include one or more target materials having an atomic number approximately greater than or equal to 70 to provide efficient x-ray generation.

When electrons from the electron beam enter the target, they give up energy in the form of heat and x-rays (photons), and lose velocity. In operation, an accelerated electron beam impinges on the target, generating Bremsstrahlung and k-shell x-rays (see Section 6.4 below).

The target 22 may be mounted in a metallic holder 24, which may be a good thermal and electrical conductor, such as copper. The holder 24 may include an electron collector 26 to collect electrons that are not stopped within the target 22 and/or that are generated within the target 22. The collector 26 may be a block of electron absorbing material such as a conductive graphite based compound. In general, the collector 26 may be made of one or more materials with an atomic number approximately less than or equal to 6 to provide both electron absorption and transparency to x-rays generated by the target 22. The collector 26 may be electrically isolated from a holder by an insulating layer 28 (e.g., a layer of anodized aluminum). In an example, the collector 26 is a heavily anodized aluminum slug.

A collimator 29 can be attached to the target structure. The collimator 29 shapes the x-ray beam into an appropriate shape. For example, if the TW LINAC is being used as an x-ray source for a cargo inspection system, the collimator 29 may form the beam into a fan shape. The x-ray beam may then penetrate a target (e.g., a cargo container), and a detector at an opposite end of the target may receive x-rays that have not been absorbed or scattered. The received x-rays may be used to determine properties of the target (e.g., contents of a cargo container).

An x-ray intensity monitor 31 can be used to monitor the yield of the x-ray during operation (see FIG. 2). A non-limiting example of an x-ray intensity monitor 31 is an ion chamber. The x-ray intensity monitor can be positioned at or near the x-ray source, for example, facing the target. In one embodiment, based on measurements from the x-ray intensity monitor 31 from one pulse of the LINAC to another, the frequency controller can transmit a signal to the one or more oscillators to cause the electromagnetic wave source to generate an electromagnetic wave at a frequency to maximize the yield of x-ray at an energy.

The frequency controller 1 can be interfaced with the x-ray intensity monitor 31. The frequency controller 1 can be used to monitor the measurements from the x-ray intensity monitor (which provide an indication of the x-ray yield) and use that information to provide a signal to the oscillator. The oscillator can tune the electromagnetic wave source to generate an electromagnetic wave at a frequency based on the signal from the frequency controller. In an embodiment, the frequency controller may be configured to compare a measurement from the x-ray intensity monitor that indicates the yield of the first beam of x-rays emitted in a desired range of x-ray energies to a measurement from the x-ray intensity monitor that indicates the yield of the second beam of x-rays at that range of x-ray energies. The second beam of x-rays can be generated using a set of electrons that is accelerated in the accelerator structure by an electromagnetic wave that has about the same amplitude as that used in the generation of the first beam of x-rays. For example, the electromagnetic waves can have about the same magnitude if they differ by less than about 0.1%, less than about 1%, less that about 2%, or more. The frequency of the electromagnetic wave delivered to the LINAC for generating the second beam of x-rays can differ in magnitude from the frequency of the electromagnetic wave delivered to the LINAC for generating the first beam of x-rays by a small amount (δf). For example, δf may be a difference on the order of about one or a few parts in 10,000 of a frequency in Hz. In some embodiments, δf can be a difference on the order of about 0.001 MHz or more, about 0.01 MHz or more, about 0.03 MHz or more, about 0.05 MHz or more, about 0.08 MHz or more, about 0.1 MHz or more, or about 0.15 MHz or more. The frequency controller can transmit a signal to the oscillator so that the oscillator causes the electromagnetic wave source to generate a subsequent electromagnetic wave at a frequency to maximize the yield of a x-rays in a subsequent operation of the LINAC.

The frequency controller can tune the frequency of the electromagnetic wave by monitoring both (i) the phase shift of the electromagnetic wave from the input to the output of the accelerator structure and (ii) the dose from the x-ray intensity monitor.

In another embodiment, the frequency controller can also be interfaced with an electron energy spectrum monitor 27 (see FIG. 2). A non-limiting example of an electron energy spectrum monitor is an electron absorber followed by an electron current monitor. For example, an electron current monitor can be configured to measure the current reaching the electron current collector 26 in the target assembly (see FIG. 2). The electron energy spectrum monitor can be positioned near the output of the accelerator structure. The electron energy spectrum monitor can be used to monitor the electron current of the output of electrons for a given pulse of the LINAC. Based on the measurements from the electron energy spectrum monitor, the frequency controller transmits a signal to the oscillator so that the oscillator tunes the electromagnetic wave source to the desired frequency. In this embodiment, the frequency controller can be configured to compare an indication of a first energy spectrum of a first output of electrons from the output of the accelerator structure to an indication of a second energy spectrum of a second output of electrons from the output of the accelerator structure, and transmit a signal to the oscillator based on the comparison. For example, the frequency controller can be configured to compare a first electron current of the first output of electrons from one pulse of the LINAC to a second electron current of the second output of electrons from another pulse. The second output of electrons can be generated using an electromagnetic wave that has about the same amplitude as that used to generate the first output of electrons. For example, the electromagnetic waves can have about the same magnitude if they differ by less than about 0.1%, less than about 1%, less that about 2%, or more. The frequency of the electromagnetic wave delivered to the LINAC for generating the second output of electrons can differ in magnitude from the frequency of the electromagnetic wave delivered to the LINAC for generating the first output of electrons by a small amount (δf). For example, δf may be a difference on the order of about one or a few parts in 10,000 of a frequency in Hz. In some embodiments, δf can be a difference on the order of about 0.001 MHz or more, about 0.01 MHz or more, about 0.03 MHz or more, about 0.05 MHz or more, about 0.08 MHz or more, about 0.1 MHz or more, or about 0.15 MHz or more. Based on the signal from the frequency controller, the oscillator can cause the electromagnetic wave source to generate a subsequent electromagnetic wave at a frequency to stabilize the energy of a subsequent output of electrons.

In an embodiment, the frequency controller can tune the frequency of the electromagnetic wave by monitoring both (i) the phase shift of the electromagnetic wave from the input and the output of the accelerator structure and (ii) the electron current of the output of electrons.

In yet another embodiment, the frequency controller can tune the electromagnetic wave source primarily by monitoring the phase shift of the electromagnetic wave from the input and the output of the accelerator structure, and as a secondary measure can monitor the doses of the x-ray intensity monitor and the electron current of the output of electrons.

The frequency controller can be configured to tune the frequency of the electromagnetic wave source, based on the monitoring of the phase, x-ray yield, and/or energy spectrum of the output electrons from pulses of the LINAC as described herein, in an iterative process. That is, the frequency controller can be configured to tune the electromagnetic wave source in an iterative process so that, with each subsequent pulse of the LINAC for a given energy of operation, the yield of x-rays is further improved until it reaches the maximum or is maintained at the maximum, or the stability of the energy spectrum of the output of electrons is further increased or maintained.

6.2 Multi-Energy Traveling Wave Linear Accelerator Operation Theory

In a one energy LINAC, the accelerator structure 8 is configured such that the electron bunch rides at the crest of the high energy electromagnetic waves throughout the accelerator structure 8, except in the first few cells of the accelerator structure 8 that comprise the buncher. This can be accomplished by ensuring that the electric field of the electromagnetic waves remains in phase with the electron bunches that are being accelerated. An electron bunch that rides at the crest of the electromagnetic wave receives more energy than an electron bunch that rides off the crest, which increases efficiency of the LINAC. Moreover, the crest of the electromagnetic wave has a slope of zero. Therefore, if jitter occurs to cause the electron bunch to move off of the crest of the wave, the amount of energy imparted to the electron bunch changes only by a very small amount. Furthermore, the bunch has a finite length. If it rides at the crest which has zero slope the electron beam will have a narrower spectrum. For these reasons, it is desirable to have the electron bunch ride the crest of the electromagnetic waves.

Figure 3:
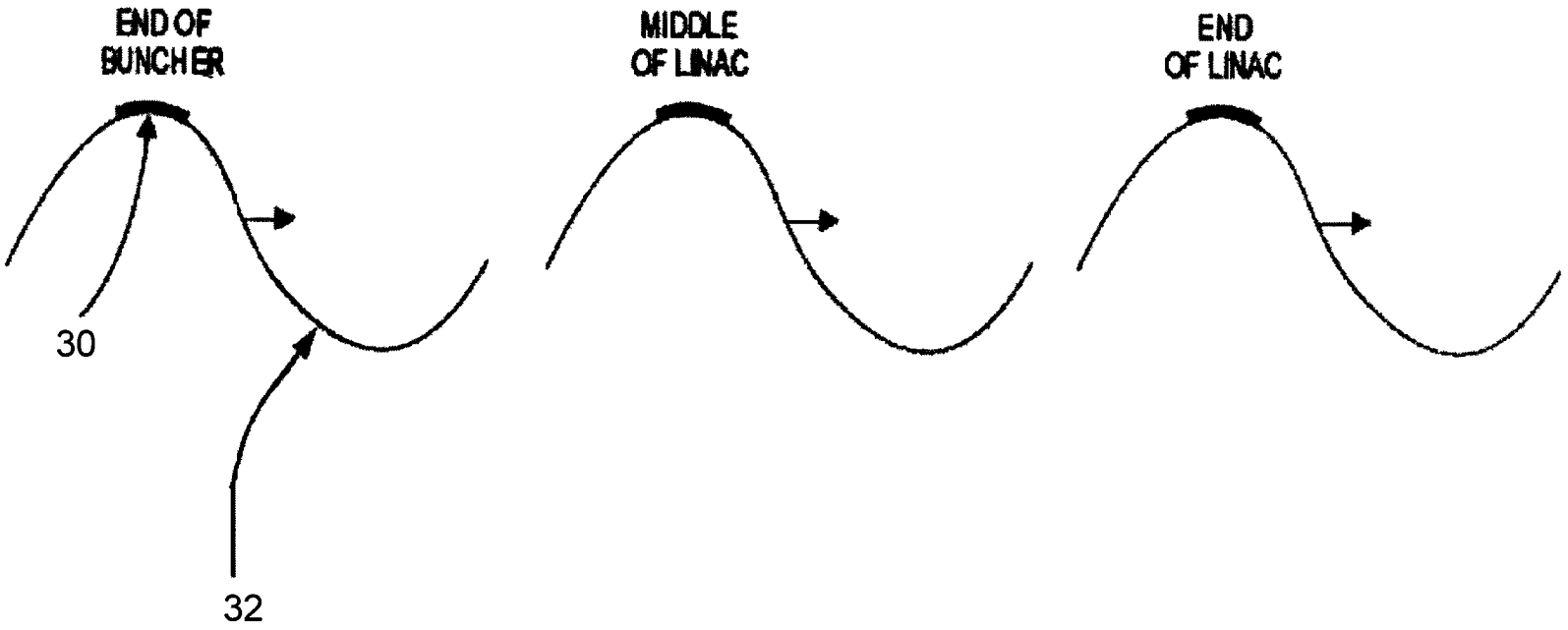
FIG. 3 illustrates an electron bunch riding an electromagnetic wave at three different regions in an accelerator structure.

FIG. 3 illustrates an electron bunch 30 riding an electromagnetic wave 32 (also referred to as a carrier wave) at the beginning of the accelerator structure (just after exiting the buncher), at the middle of the accelerator structure, and at the end of the accelerator structure (just before striking the target). FIG. 3 illustrates a higher energy operation of the LINAC, where electron bunch 30 can ride substantially at the crest of the electromagnetic wave 32 at each region of the accelerator structure (substantially synchronous).

In a multi-energy LINAC, the accelerator structure is typically configured such that at the higher energy operation the electron bunches 30 ride at the crests of the high energy electromagnetic waves 32, as is shown in FIG. 3. However, to impart less energy on the electron beam for the lower energy operation, the strength (amplitude) of the electromagnetic wave can be reduced by reducing the output power of the klystron 6 (e.g., by reducing the input drive power to the klystron 6 or by reducing the klystron high voltage pulse). As another exemplary way to impart less energy on the electron beam for the lower energy operation, the acceleration imparted by the electromagnetic wave also can be reduced by increasing the beam current from the electron gun 14 in an effect referred to as beam loading (described in Section 6.3 below). The lower strength electromagnetic wave accelerates the electron bunches at a slower rate than the higher strength electromagnetic waves. Therefore, when the RF field amplitude is lowered to lower the energy of the x-ray beam, the electron bunches gain energy less rapidly in the buncher and so end up behind the crest of the wave at the end of the buncher. This causes the electron bunches to fall behind the crest of the waves by the end of the buncher region of the accelerator structure. If the RF frequency is the same for the low energy level as for the high energy level, the bunch will stay behind the crest in the accelerator structure, resulting in a broad, undesirable, energy spectrum.

When the electron bunch does not travel at the crest of the electromagnetic wave, the efficiency of the LINAC is reduced, and therefore greater power is required than would otherwise be necessary to generate the lower power x-ray beam. More importantly, since the electron bunch is not at the crest of the wave, any jitter can cause the electron bunch to move up or down on the electromagnetic sine wave. Thus, the energy of the x-ray beam will fluctuate in response to phase fluctuations caused by jitter in the RF frequency, variation in the gun voltage or current, and amplitude and variation in the accelerator structure temperature. This changes the amount of energy that is imparted to the electron bunch, which causes instability and reduces repeatability of the resultant x-ray beam. However, reducing the beam energy by increasing the beam current has a significantly different effect than by reducing the input drive power. When the input power is reduced, the RF fields throughout the LINAC decrease by the same percentage. When the beam current is increased in a TW LINAC, the percentage decrease at the input end of the LINAC is very small and the change increases roughly linearly with distance along the LINAC. Most of the decrease in energy occurs after the electrons are relativistic and has very little effect on their velocities. Consequently, when a two energy operation is achieved by changing the gun current, it can be quite satisfactory to accelerate both of the energies beams with the same frequency RF power, which is a compromise placing the higher energy slightly ahead of the crest and the lower energy beam slightly behind the crest. In one simulation with two energies, 6 MeV and 4 MeV, were run with the same RF power and the same RF frequency. The 4 MeV beam was obtained using a higher gun current (about 100 mA higher captured beam current). The 6 MeV bunch ended up about 8° ahead of the crest and the 4 MeV beam was 8° behind the crest. Each beam lost about 1% energy by not being on the crest and both had good spectra.

Three typical sources of jitter include frequency jitter from the RF source, temperature variation from the accelerator structure and amplitude jitter from the RF source. All three sources of jitter can cause the electron bunch to move up or down on the electromagnetic sine wave. Additionally, amplitude jitter of the RF source also can cause jitter in the amplitude of the accelerating fields throughout the LINAC.

A standing wave LINAC has a fixed number of half wavelengths from one end of the accelerator structure to the other, equal to the number of resonant accelerating cavities. Therefore, the phase velocity of the electromagnetic waves cannot be changed in a standing wave LINAC. For the standing wave LINAC, when the frequency of the electromagnetic wave is changed, the electromagnetic wave moves off the resonance frequency of the accelerator structure, and the amplitude of the electromagnetic waves decreases. However, the phase velocity is still the same, and the accelerator structure still has the same number of half wavelengths. Therefore, the standing wave LINAC cannot be adjusted to cause the electron bunch to ride at the crest of the electromagnetic wave for multiple energy levels.

Traveling wave LINACS have the property that rather than having discrete modes (as in a standing wave LINAC), they have a continuous pass band in which the phase velocity (velocity of the electromagnetic wave) varies continuously with varying frequency. In a TW LINAC the phase velocity of the electromagnetic wave can be changed with the change in frequency.

Figure 4:
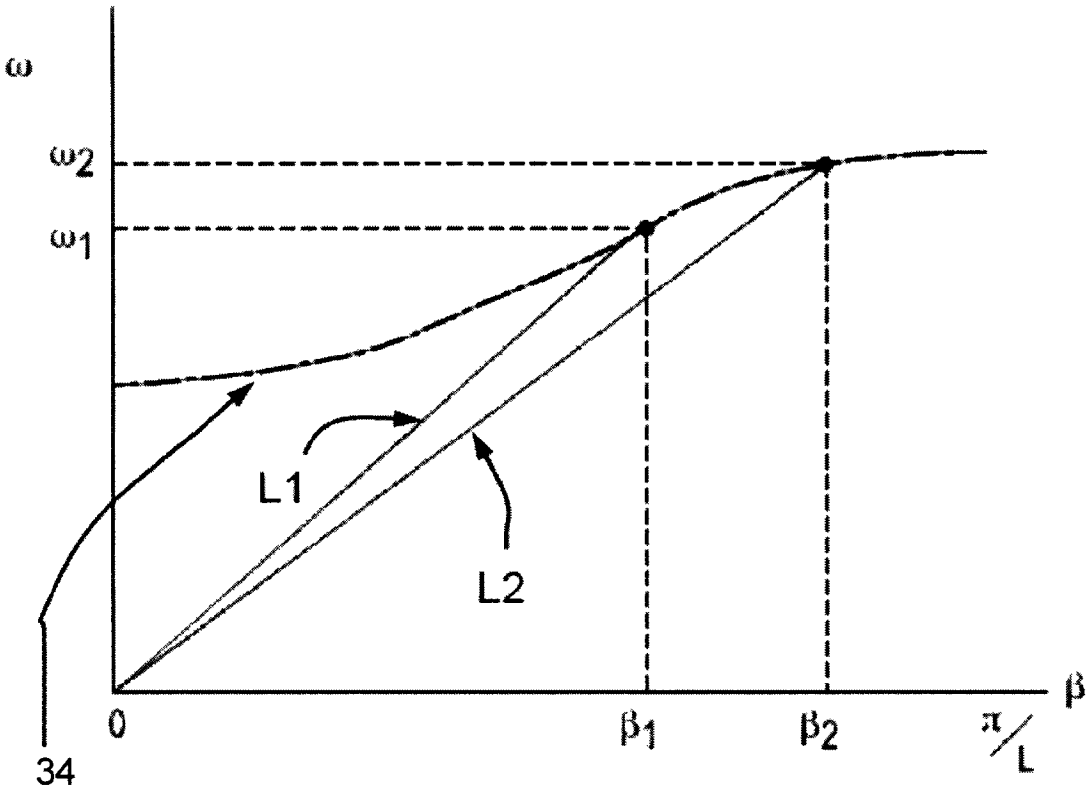
FIG. 4 illustrates a dispersion curve for an exemplary TW LINAC after an electron beam has passed through the buncher.

FIG. 4 illustrates a dispersion curve 34 for an exemplary TW LINAC. The dispersion curve 34 in FIG. 4 graphs angular frequency ($\omega=2\pi f$, wherein f is the frequency of the electromagnetic wave in the accelerator structure) vs. the propagation constant ($\beta=2\pi/\lambda$, where $\lambda$ is the wavelength of the electromagnetic wave in the accelerator structure) for the exemplary TW LINAC. The propagation constant, $\beta$, is the phase shift of the RF electromagnetic wave per unit distance along the Z axis of the TW LINAC. The phase velocity of an electromagnetic wave in the TW LINAC is equal to the slope, $\omega/\beta$, of the line from the origin to the operating point, $\omega,\beta$, which is equal to the frequency times the wavelength of the electromagnetic wave ($f\lambda$). As shown, the phase velocity of the electromagnetic wave varies continuously with varying frequency. The group velocity (the velocity with which a pulse of the electromagnetic wave propagates) is given by $d\omega/d\beta$, the slope of the dispersion curve. The change of phase, $\delta\phi(z)$, at a longitudinal position z in the TW LINAC caused by a change of angular frequency $\delta\omega$, is given by the equation:

$$\delta\phi(z)=\delta\Omega\int dz/(d\omega/d\beta)=\delta\omega\int dz/v_g=\delta\omega t_f(z) \quad (1)$$

where $t_f(z)$ is the filling time from the beginning of the LINAC to the position z.

In general for LINACs, the dispersion curve, and therefore both the phase velocity and the group velocity, can vary from cell to cell. In the TW LINAC used as an example here, for the maximum energy operation most of the LINAC has a constant phase velocity equal to the velocity of light. However, the structure is designed to have an approximately constant gradient, which means that the group velocity decreases approximately linearly with distance along the LINAC. Therefore, when the frequency is changed (raised) for operation at the lower energy level (e.g., at 6 MeV), to achieve a maximum possible energy the phase velocity is no longer constant during the portion of acceleration at which the electrons travel at approximately the speed of light.

As the angular frequency of an electromagnetic wave is increased in the typical, forward wave TW LINAC, the phase velocity of the electromagnetic wave is decreased. Thus, if the angular frequency of an electromagnetic wave used to generate a high energy electron beam is $\omega_1$ and the angular frequency of an electromagnetic wave used to generate a low energy electron beam is $\omega_2$, the slope of $\omega_1/\beta_1$ (L1) will be steeper than the slope of $\omega_2\beta_2$ (L2). Accordingly, the phase velocity of the electromagnetic wave that generates the high energy x-ray beam is higher than the phase velocity of the electromagnetic wave that generates the low energy x-ray beam. The angular frequency of the electromagnetic wave used to generate the high energy x-ray beam can be chosen such that the phase velocity for the electromagnetic wave ($\omega_1/\beta_1$) is approximately equal to the speed of light, through most of the LINAC.

Figure 5:
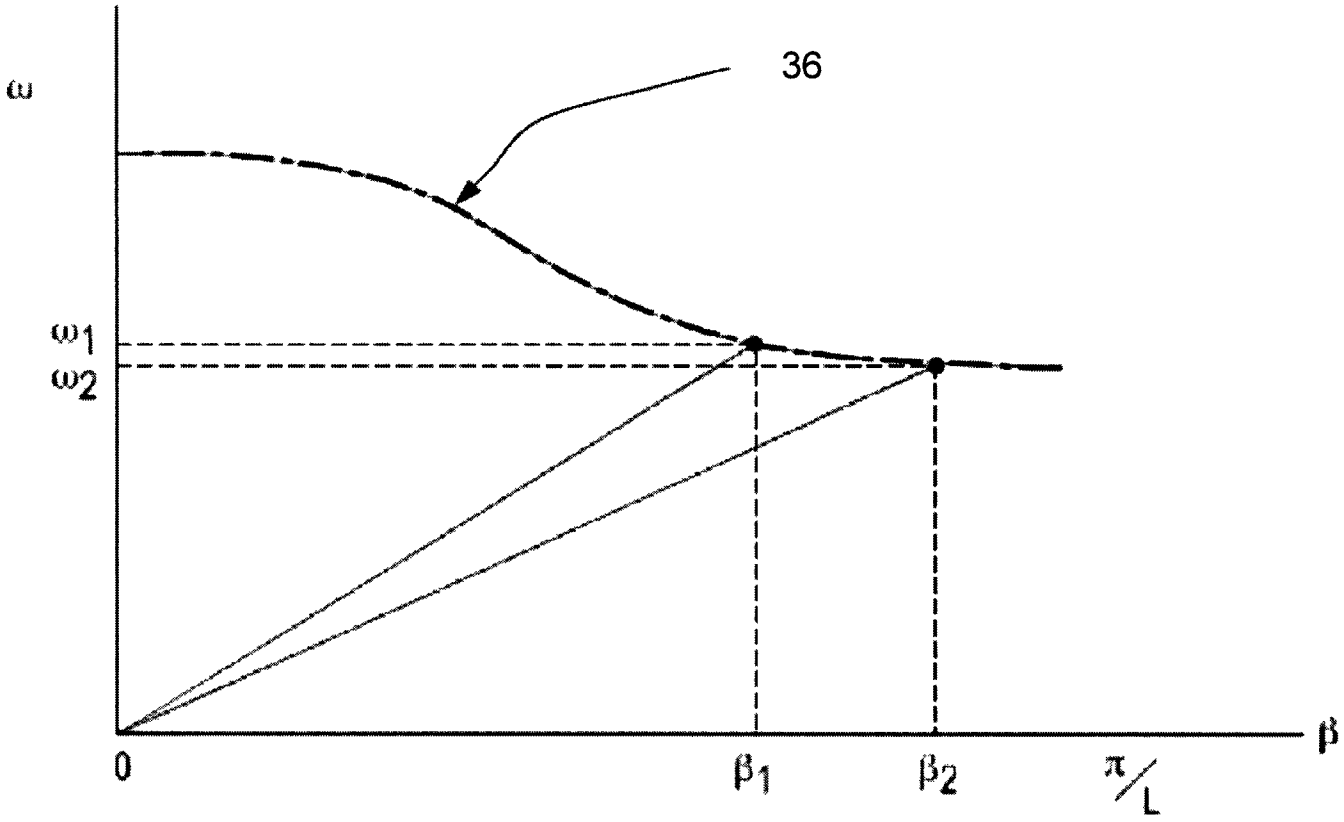
FIG. 5 illustrates a dispersion curve for a high efficiency magnetically coupled reentrant cavity TW LINAC.

FIG. 5 illustrates a dispersion curve 36 for a high efficiency magnetically coupled reentrant cavity traveling wave LINAC. In the dispersion curve 36 in FIG. 5, the y-axis represents angular frequency and the x-axis represents propagation constants. As shown, in the high efficiency magnetically coupled reentry cavity TW LINAC configuration, the phase velocity varies continuously with changing frequency. However, the dispersion curve 36 of FIG. 5 shows a different relationship between angular frequency and phase velocity than is shown in the dispersion curve 34 of FIG. 4. For example, in the dispersion curve 36 of FIG. 5, angular frequency associated with the high energy electron beam is higher than the angular frequency associated with the low energy electron beam. This is in contrast to the dispersion curve 34 of FIG. 4, in which the angular frequency associated with the high energy beam is lower than the angular frequency associated with the low energy electron beam. The relationship between angular frequency and phase velocity can differ from LINAC to LINAC, and therefore the specific angular frequencies that are used to tune a TW LINAC should be chosen based on the relationship between angular frequency and phase velocity for the TW LINAC that is being tuned. A magnetically coupled backward wave traveling wave constant gradient LINAC with nose cones operating near the $3\pi/4$ or $4\pi/5$ mode could have a shunt impedance and therefore efficiency as high as a cavity coupled standing wave accelerator.

In one embodiment, the phase velocity of the electromagnetic wave can be adjusted to cause the electron bunch to, on average, travel at the crest of the electromagnetic wave. Alternately, the phase velocity of the electromagnetic wave can be adjusted to cause the electron bunch to, on average, travel ahead of the crest of the electromagnetic wave. Adjustments to the phase velocity can be achieved for multiple different energy levels simply by changing the frequency of the electromagnetic wave to an appropriate level. Such an appropriate level can be determined based on the dispersion curves as shown in FIGS. 4 and 5. For example, the RF frequency of the electromagnetic wave can be raised to reduce the phase velocity of the wave so that the electron bunch moves faster than the wave and drifts up toward the crest as it travels through the accelerator. Changing the RF frequency of the TW LINAC is easy to do on a pulse to pulse basis if the RF source is a klystron 6, thus allowing interleaving of 2 or more energies at a high repetition rate. Frequency changes can also be made when other RF sources are used. This strategy will work for a wide energy range (e.g., including either the full single structure X-band or the full single structure S-band energy range).

Figure 6:
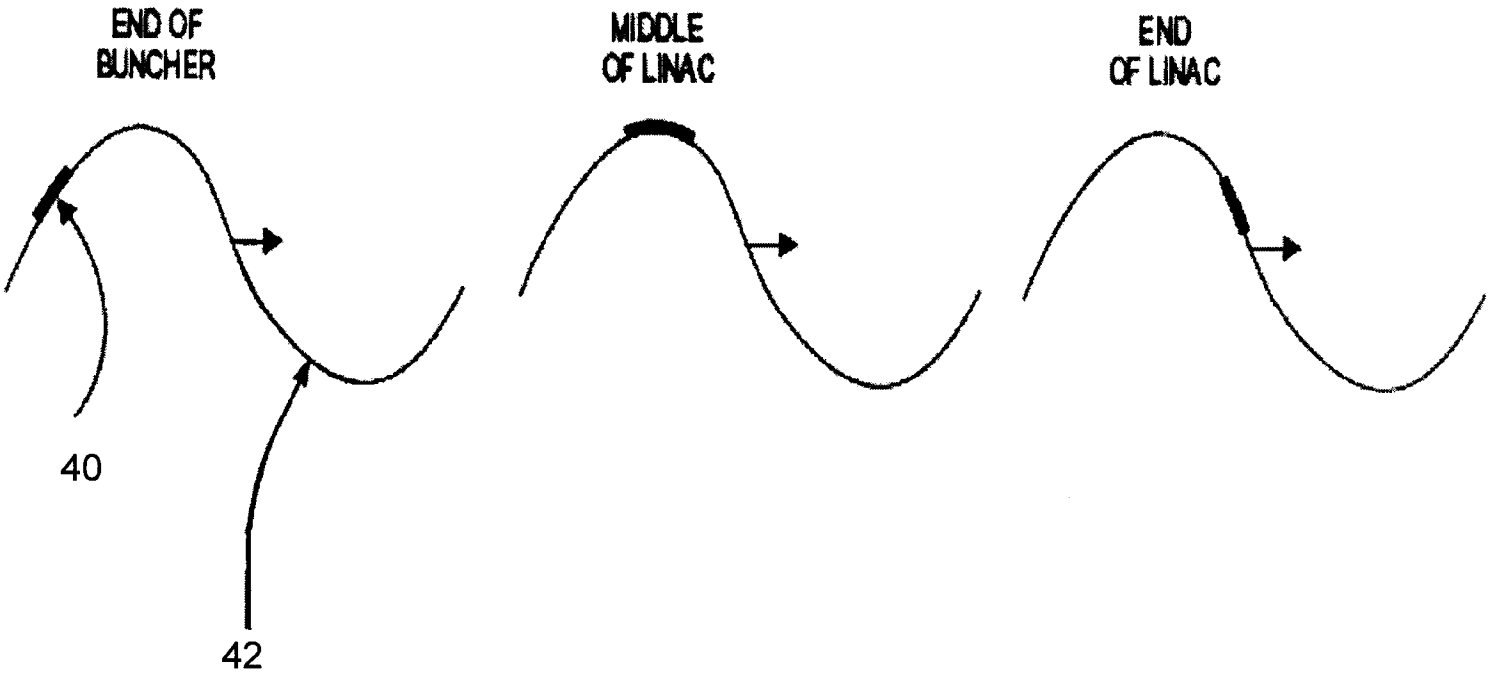
FIG. 6 illustrates an electron bunch riding an electromagnetic wave at three different regions in an accelerator structure of a TW LINAC.

FIG. 6 illustrates an electron bunch 40 riding an electromagnetic wave 42 at three different regions in an accelerator structure of a TW LINAC. FIG. 6 illustrates a lower energy operation of the LINAC. The electron bunch is depicted in FIG. 6 as substantially non-synchronous. The phase velocity of the electromagnetic wave has been adjusted such that the phase velocity is slower than the speed of the electron bunches (e.g., by increasing the RF frequency of the electromagnetic wave). In this lower energy beam operation, the electromagnetic fields can be smaller and the electron beam can be accelerated more slowly in the buncher region. When the electron bunch leaves the buncher region of the accelerator structure, it can be behind the crest of the electromagnetic wave. At approximately the middle of the accelerator structure, the electron bunch 40 is at the crest of the electromagnetic wave 42. At the end of the accelerator structure, the electron bunch 40 is ahead of the crest of the electromagnetic wave 42. On average, the electron bunch 40 is at the crest of the electromagnetic wave 42. Therefore, the electron bunch has an energy spectrum that is equivalent to an electron bunch that rides at the crest of a smaller amplitude electromagnetic wave throughout the accelerator structure. As a result, jitter does not cause a significant change in energy of the electron beam, and thus of a resulting x-ray beam.

In one embodiment, the phase velocity is adjusted so that the bunch is as far ahead of the crest at the end of the accelerator structure as it was behind the crest at the end of the buncher region of the accelerator structure for a given energy level. That way the electrons at the head of the bunch that gained more energy in the first half of the accelerator structure than the electrons at the tail of the bunch can gain less energy in the second half of the accelerator structure, and the two effects cancel to first order. Similarly, if the RF frequency jitters by a tiny amount causing the electron bunch to be farther behind at the beginning so that it gains less energy in the first half of the accelerator, it gains more energy in the second half, thus minimizing the energy jitter. The net effect of adjusting the frequency in this way is to make the energy distribution within the bunch at the end of the accelerator structure look as if the bunch rode on the crest of a smaller amplitude wave throughout the accelerator. This adjustment of the frequency can also maximize the energy gain (provide maximum x-ray yield) for the particular amplitude of the electromagnetic waves and reduce beam energy dependence on RF power level.

In another embodiment, the phase velocity is adjusted so that the bunch is further ahead of the crest at the end of the accelerator structure than it was behind the crest at the beginning of the accelerator structure for a given energy level. In other words, the RF frequency is raised to above the point where maximum x-ray yield can be obtained. Such an adjustment can address amplitude jitter introduced into the accelerating fields of the LINAC based on amplitude jitter in the RF source. It should be noted, however, that such an adjustment can cause a wider energy spectrum of the electron beam and the x-rays than adjusting the phase velocity so that the bunch is as far ahead of the crest at the end of the accelerator structure as it was behind the crest at the beginning of the accelerator structure for a given energy level.

As discussed above, frequency jitter from the RF source, temperature variation from the accelerator structure and amplitude jitter from the RF source all cause the electron bunch to move off the peak of the electromagnetic wave. However, amplitude jitter in the RF source also causes jitter in the amplitude of the accelerating fields throughout the LINAC. When the phase velocity (e.g., RF frequency) is adjusted to place the bunch, on average, ahead of the peak of the electromagnetic wave, the jitter in the amplitude of the accelerating fields can be ameliorated. The amplitude of the RF source can also be adjusted to ameliorate the amplitude jitter. Alternatively, or in addition, the pulse repetition rate of the LINAC can be changed to ameliorate the sources of jitter. For example, where there is a 180 Hz or 360 Hz ripple experienced by the TW LINAC when operating at 6 MeV, the pulse repetition rate can be changed from 400 pulses per second (pps) to 360 pps to alleviate jitter.

The jitter in the x-ray yield can be strikingly reduced by raising the RF frequency above the point where the maximum x-ray yield is obtained. This is optimum because when the frequency is raised above the maximum x-ray yield point it reduces the phase velocity of the electromagnetic wave and moves the bunch ahead of the accelerating crest on average in the LINAC. Then, if the RF amplitude jitters upward, the bunch moves farther ahead of the crest and the downward slope of the sine wave compensates for the increase in the accelerating fields in the LINAC. At some frequency the derivative of beam energy or x-ray yield with respect to RF power actually vanishes.

In one embodiment, the optimum RF frequency depends on the relative amplitude of the three sources of x-ray yield jitter. If the bunch is moved forward of the accelerating crest by just increasing the RF frequency, the beam energy and the x-ray yield will decrease. However, the bunch can be moved forward of the accelerator crest by increasing both the frequency and the amplitude of the RF drive, in a manner which keeps the energy approximately constant. In one embodiment, in the commissioning of a LINAC system, when a beam energy spectrometer is available, the function of power versus RF frequency above the maximum x-ray yield point, for each operating energy, is measured. Then an operator can find the point along this power versus frequency curve which gives the best stability and operate there.

The ability to change the phase velocity of the wave by just changing the frequency (or by changing the frequency and amplitude) enables the electron bunch to be at an optimum position relative to an electromagnetic wave for a given energy level. Therefore, stable x-rays can be generated at a range of energy levels. This causes the TW LINAC to be less susceptible to temperature changes, less susceptible to jitter in the frequency of the electromagnetic wave, and less susceptible to jitter in the amplitude of the electromagnetic wave.

6.3 Use of a Frequency Controller in the Operation of a Multi-Energy TW LINAC

In a multi-energy interleaving operation of a TW LINAC, a frequency controller can be used to measure the phase shift of the electromagnetic wave through the LINAC structure by comparing the phase of the electromagnetic wave at the input of the accelerator structure to the phase of the electromagnetic wave at the output of the accelerator structure. The frequency controller can transmit a signal to the oscillator to modify the frequency of the electromagnetic wave that is ultimately coupled into the accelerator structure based on the magnitude of the phase shift detected by the frequency controller. In a non-limiting example, the frequency controller can be an automatic frequency controller (AFC). The frequency controller can be a multi-frequency AFC, and can operate at a set point for each of a number of different frequencies, with each frequency being associated with each different energy. The frequency controller can be used to measure the RF phase of the electromagnetic wave at the output coupler relative to the RF phase of the electromagnetic wave at the input coupler. With this information, the frequency controller can be used to adjust the frequency of the electromagnetic wave, to maintain the phase shift through the LINAC to a separate set point for each of the different energies of operation of the LINAC. The frequency controller can facilitate stable operation with quick settling during rapid switching of a multi-energy interleaved TW LINAC. For example, the frequency controller can be used to correct for the effect of rapid thermalization of the TW LINAC accelerator structure when the system is stepping from standby to full power, drifts in the temperature of the accelerator structure cooling water, or drifts in the frequency of the oscillator.

Figure 7:
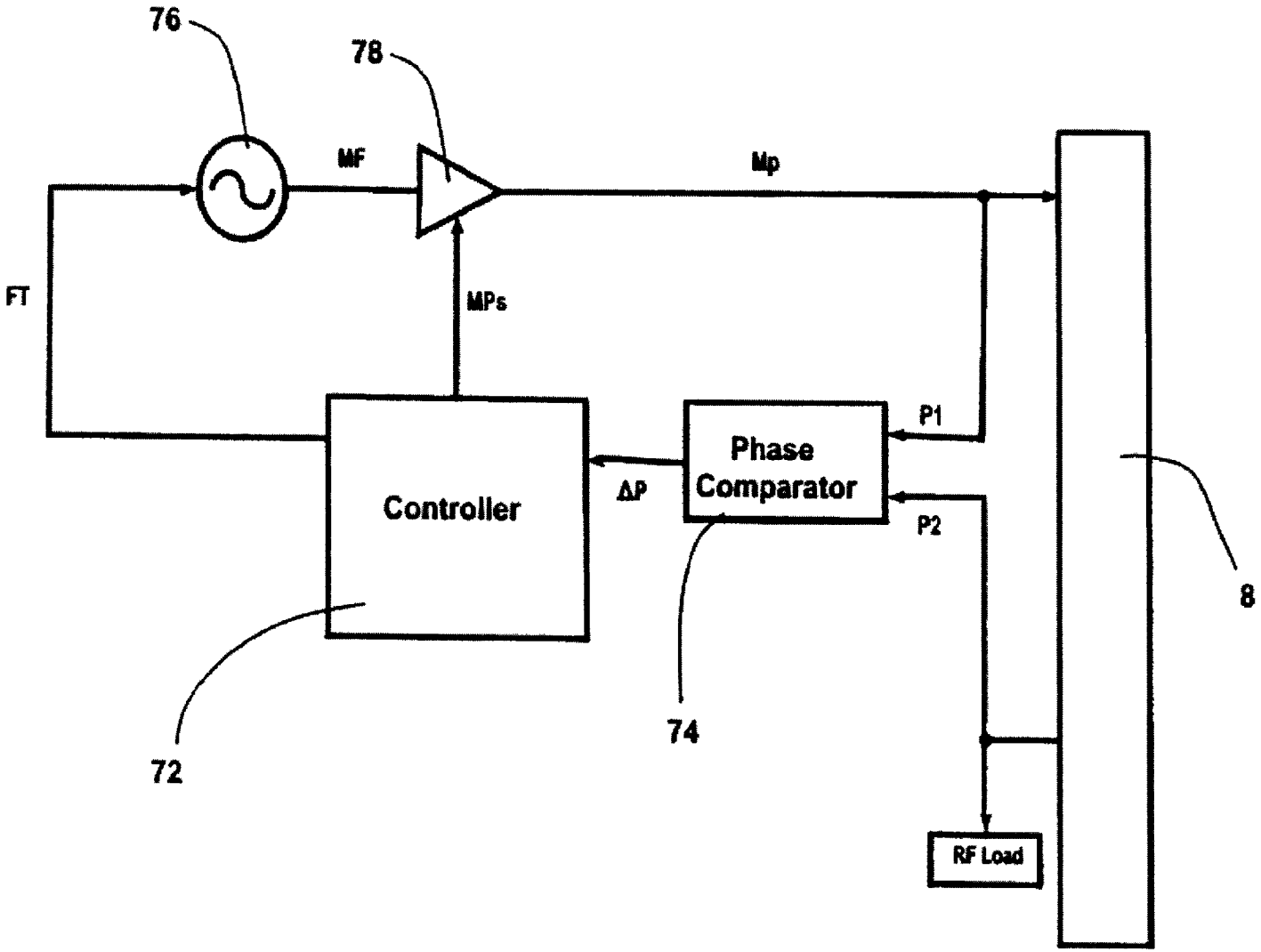
FIG. 7 illustrates a block diagram of a TW LINAC comprising a frequency controller.

FIG. 7 shows a block diagram of an embodiment of a TW LINAC comprising a frequency controller. In the illustration of FIG. 7, the frequency controller comprises a controller 72 and a phase comparator 74. In the example of FIG. 7, the phase comparator 74 compares the electromagnetic wave at the input of the accelerator structure 8 (P1) and at the output of the accelerator structure 8 (P2) and provides a measure of the phase shift (ΔP) to the controller 72. The frequency controller can transmit a signal to the oscillator 76 to tune the frequency of the oscillator 76. As discussed above, the oscillator 76 can generate a signal having a frequency that is provided by the frequency controller, and the RF signal can be amplified by the amplifier 78 and supplied to a klystron (see FIG. 1A). Thus, the signal from the frequency controller to the oscillator 76 can ultimately result in a modification of the frequency of the electromagnetic wave that is coupled into the accelerator structure, based on the magnitude of the phase shift detected by the frequency controller. As discussed above, the amplifier 78 may adjust the RF power supplied to the klystron based on the RF pulse rise time determined by the intensity controller. The RF pulse rise time may be calculated at the intensity controller using, for example, a lookup table. The oscillator 76 can also generate a signal that results in a change of the frequency of the electromagnetic wave by an amount to change the operating energy of the LINAC in the time interval between electromagnetic wave pulses in an interleaving operation. The frequency controller is illustrated in FIG. 7 as comprising a controller 72 and a phase comparator 74 as separate units. However, in other embodiments, the frequency controller can comprise the controller and phase comparator as an integral unit.

Figure 8:
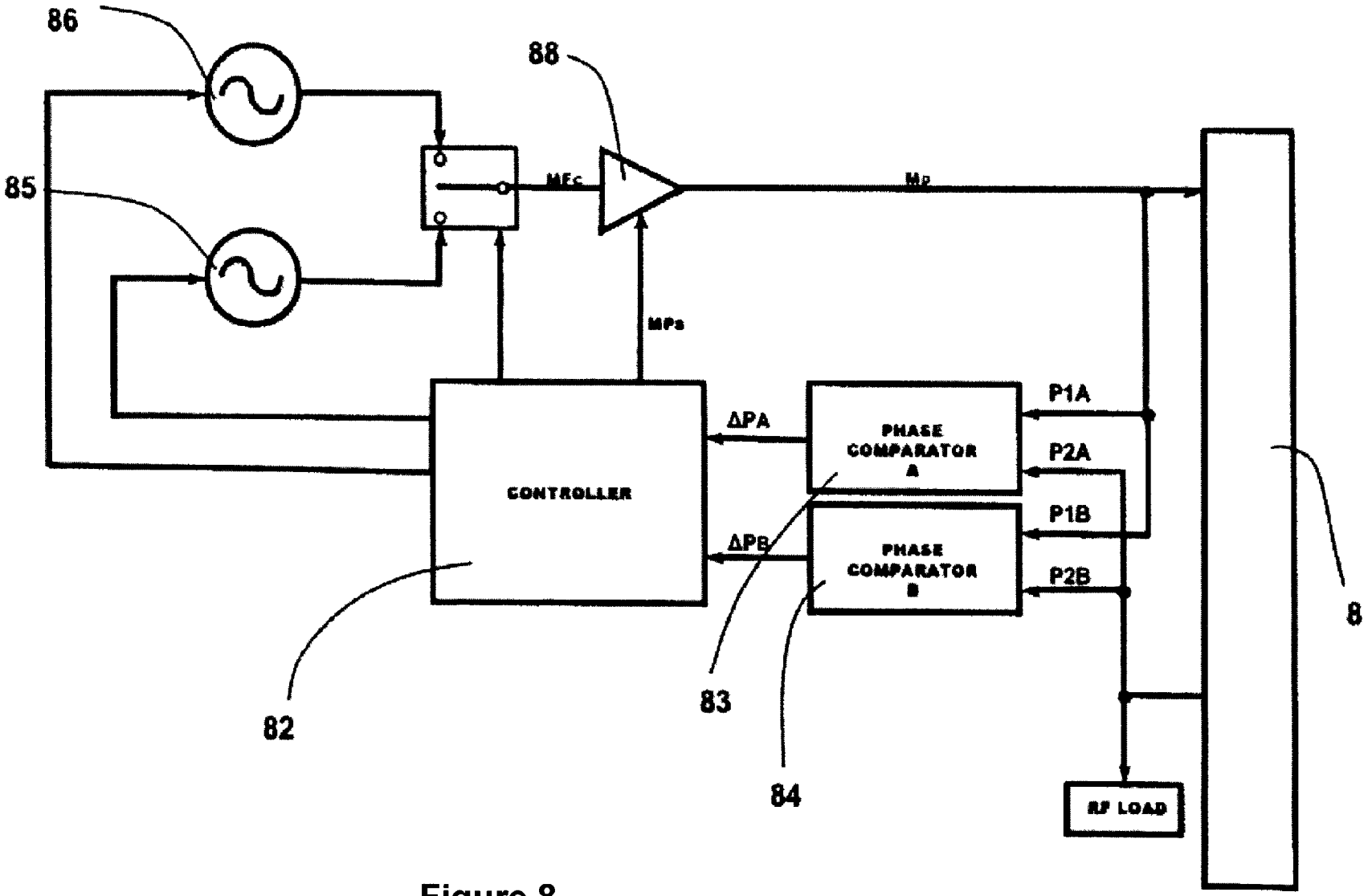
FIG. 8 illustrates another block diagram of a TW LINAC comprising a frequency controller.

FIG. 8 shows a block diagram of another embodiment of a TW LINAC comprising a frequency controller that can be used for a dual energy operation. In the illustration of FIG. 8, the frequency controller comprises a controller 82, and two phase comparators (phase comparator A 83 and phase comparator B 84) that are each used for a different energy of operation of the LINAC. Phase comparator A 83 compares the electromagnetic wave at the input of the accelerator structure 8 (P1A) and at the output of the accelerator structure 8

(P2A) and provides a measure of the phase shift (ΔPA) to the controller 82. Phase comparator B 84 compares the electromagnetic wave at the input of the accelerator structure 8 (P1B) and at the output of the accelerator structure 8 (P2B) and provides a measure of the phase shift (ΔPB) to the controller 82. The illustration of FIG. 8 includes two oscillators (oscillator 85 and oscillator 86), each used for a different energy of operation of the LINAC. Frequency controller 82 can transmit a signal to oscillator 85 to tune the frequency of oscillator 85 based on the measured phase shift ΔPA of an electromagnetic wave used to accelerate a set of electrons to the desired first energy of operation. In addition, frequency controller 82 can also transmit a signal to oscillator 86 to tune the frequency of oscillator 86 based on the measured phase shift ΔPB of an electromagnetic wave used to accelerate a set of electrons to the desired second energy of operation. As discussed above, oscillators 85 and 86 can each generate an RF signal having a frequency that is provided by the frequency controller, and the RF signal can be amplified by amplifier 88 and supplied to a klystron (see FIG. 1A). Thus, the signal from the frequency controller to oscillator 85 (or oscillator 86) can ultimately result in a modification of the frequency of the electromagnetic wave that is coupled into the accelerator structure, for a given energy of operation, based on the magnitude of a phase shift detected by the frequency controller. As discussed above, the amplifier 88 may adjust the RF power supplied to the klystron based on the RF pulse rise time determined by the desired energy of the electron beam. The RF pulse rise time may be calculated using, for example, a lookup table. The frequency controller is illustrated in FIG. 8 as comprising a controller 82, phase comparator A 83, and phase comparator B 84 as separate units. However, in other embodiments, the frequency controller can comprise the controller and the phase comparators as an integral unit.

Figure 9:
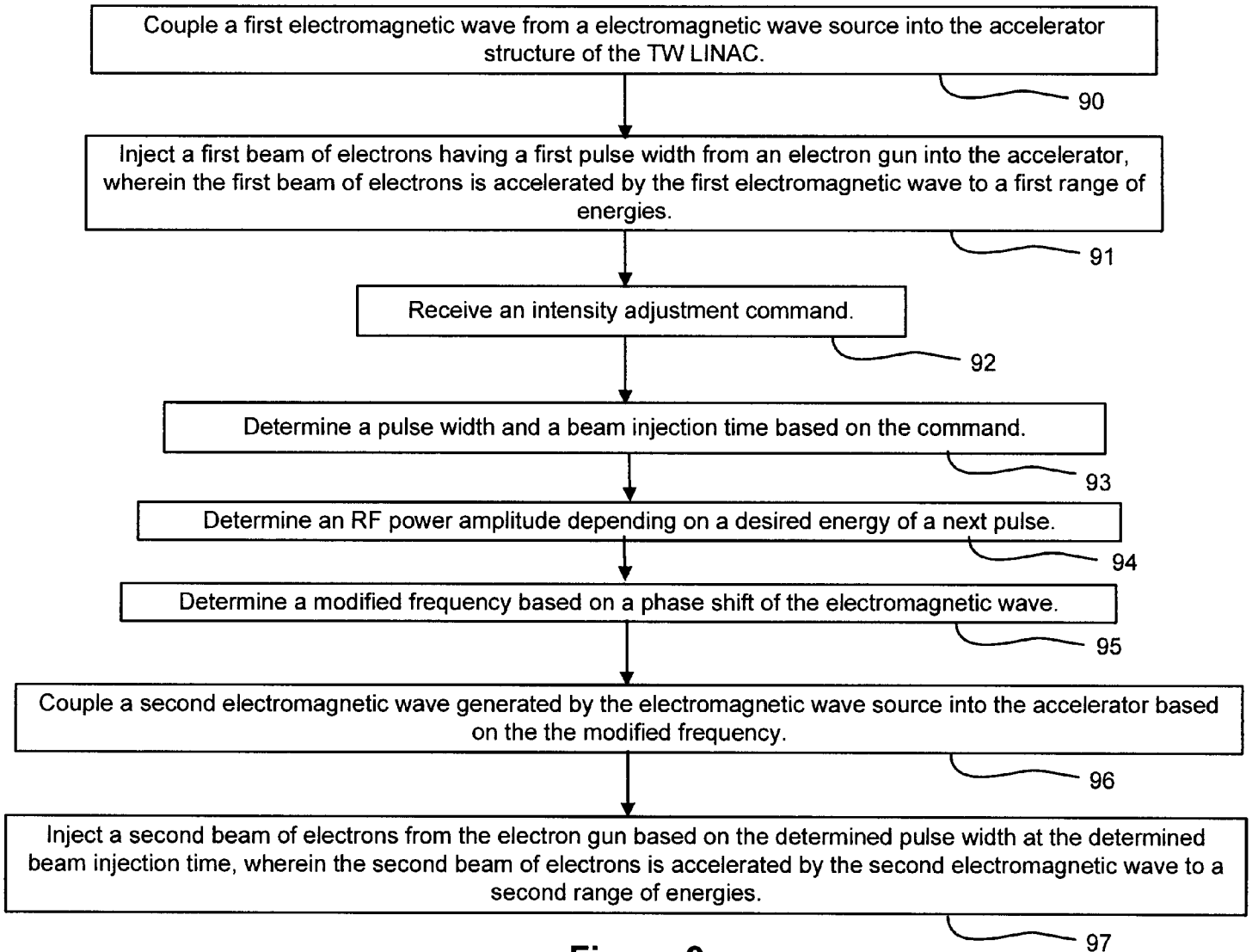
FIG. 9 shows a flow chart of an operation of a TW LINAC comprising a frequency controller.

FIG. 9 shows a flow chart of steps in an example operation of the TW LINAC. In step 90 of FIG. 9, a first electromagnetic wave from an electromagnetic wave source is coupled into the accelerator structure of the TW LINAC. In step 91, a first set of electrons having a first pulse width is injected at the input of the accelerator structure of the TW LINAC and the first set of electrons is accelerated to a first energy. In step 92, an intensity adjustment command is received at an intensity controller which may be external or integrated. In step 93, the intensity controller determines a pulse width and a beam injection time based on the command using, for example, a lookup table. In step 94, an RF power amplitude is determined based on the desired energy of the next pulse. In step 95, a modified frequency based on a phase shift of the electromagnetic wave is determined depending on the energy of the next pulse. A frequency controller may compare the phase of the electromagnetic wave at the input of the accelerator structure to the phase of the electromagnetic wave at the output to monitor the phase shift of the electromagnetic wave. The frequency controller may transmit a signal to an oscillator that includes a corrected frequency based on the magnitude of the phase shift detected by the frequency controller. For example, the corrected frequency can differ from the first frequency by an amount δf based on magnitude of the phase shift detected (for example, δf can be a difference on the order of about 0.001 MHz or more, about 0.01 MHz or more, about 0.03 MHz or more, about 0.05 MHz or more, about 0.08 MHz or more, about 0.1 MHz or more, or about 0.15 MHz or more). In step 96, a second electromagnetic wave generated by the electromagnetic wave source is coupled into the accelerator based on the modified frequency. An amplifier can cause the electromagnetic wave source to generate a subsequent electromagnetic wave. As discussed above, an oscillator can generate a signal having a frequency that is provided by the frequency controller, and that signal can be amplified by an amplifier to an RF power based on the determined RF pulse rise time and supplied to the electromagnetic wave source (such as a klystron). The electromagnetic wave source can generate the subsequent electromagnetic wave based on the amplified signal received from the amplifier. In step 97, a second beam of electrons from the electron gun based on the determined pulse width is injected at the determined beam injection time, wherein the second beam of electrons is accelerated by the second electromagnetic wave to a second range of energies. Advantageously, the central value of the second range of energies may be substantially the same as a central value of the first range of energies in a single energy operation. The range of output energies of two different sets of electrons is substantially the same if the central value (e.g., the mean value or median value) of the range of output energies differs by less than about 0.1%, less than about 1%, less that about 2%, or more. Steps 90-96 can be repeated a number of times during operation of the TW LINAC.

In an interleaving operation, the LINAC can be operated to cycle between two different output energies while the x-ray intensity is modulated from pulse-to-pulse. For example, the LINAC can be operated to alternate between about 6 MeV and about 9 MeV. In such an operation, after step 95 but prior to step 96, the LINAC can be operated at an energy (for example, about 9 MeV) that is different from the first energy of the first set of electrons (for example, about 6 MeV). The amplitude and frequency in the accelerator structure of the electromagnetic wave used for accelerating these additional electrons can be different than the electromagnetic wave used in step 90. For example, in the interleaving operation, a first electromagnetic wave is generated and used to accelerate a first set of electrons having a first pulse width to the first energy, a second electromagnetic wave (of a different amplitude and frequency) is generated and used to accelerate a second set of electrons having a second pulse width, based on a first intensity adjustment command, that is different from the first pulse width to a second energy that is different from the first energy. Then, a subsequent electromagnetic wave is generated based on the phase shift of the first electromagnetic wave (as discussed above) and used to accelerate a subsequent set of electrons having a third pulse width, based on a second intensity adjustment command, different from the first and second pulse width to substantially the same range of energies as the first energy. Then, a subsequent electromagnetic wave is generated based on the phase shift of the second electromagnetic wave and used to accelerate a subsequent set of electrons having a fourth pulse width, based on a third intensity adjustment command, different from the first, second, and third pulse width to substantially the same range of energies as the second energy, and so on. Although this interleaving operation is described as a dual energy interleaving operation, it should be noted that the exemplary TW LINAC is not limited thereto.

In yet another example of an interleaving operation, the LINAC is operated for multiple pulses at the first energy before it is operated at the second energy. The LINAC can also be operated to provide multiple pulses at the first energy and then operated to provide multiple pulses at the second energy.

In another example operation, prior to step 90, a phase set point for the first energy can be input into the phase comparator. The phase shift can be inserted into one input arm of the phase comparator so that the phase comparator outputs a reading of, e.g., zero voltage, when the phase is correct for the desired energy of the pulse. In another example, after step 92 and prior to step 94, a phase set point for the second energy can be input into the phase comparator.

The frequency controller can have several different set points for the optimum phase shift for each of the different energies at which the TW LINAC is operated. For example, the frequency controller can have N different set points for the optimum phase shift that corresponds to each of N different energies (N≥2) at which the TW LINAC is operated.

The frequency controller can perform the phase comparison continuously as a beam of electrons is accelerated in the accelerator structure. For example, the frequency controller can perform the phase comparison continuously from the moment an electromagnetic wave reaches the output end of the accelerator structure until the end of the RF pulse reaches the input of the accelerator structure. The set point for the phase bridge can be changed before another electromagnetic wave is coupled into the accelerator structure, so that the set point is appropriate for the intended energy range of the subsequent pulse of output electrons.

The frequency controller can adjust the frequency to achieve the desired phase set point. For example, for a TW LINAC in which the accelerator structure is a forward wave structure, the frequency controller can transmit a signal to result in the raising of the frequency for the lower energy operation in which the electron beam is moving slower through the buncher region. In another example, for a TW LINAC in which the accelerator structure is a forward wave structure, the frequency controller can transmit a signal to result in the lowering of the frequency for the higher energy operation in which the electron beam is moving faster through the buncher region. The transit time of the electron beam through the buncher region can differ greatly from the lower energy operation to the higher energy operation when the electrons are being accelerated from, e.g., about 15 keV (an example energy of electrons emerging from an electron gun) to about 1 MeV. The difference in transit times results from the different electric field amplitudes being applied to the electrons for the lower energy beam versus the higher energy beam. For example, electric field amplitudes used for the lower energy beam can be about ⅔ as high as that used for the higher energy beam in a dual-energy operation. The frequency controller can transmit a signal to result in the adjustment of the frequency of the electromagnetic wave to make the transit time of the electromagnetic wave crests through the structure optimized for the transit time of the electrons through the accelerator structure for each of the different energies in the interleaved operation of the TW LINAC. For example, frequency controller can transmit a signal to provide electromagnetic wave crests whose transit time through the accelerator structure is longer for lower energy electron beams.

In examples where the accelerator structure is a backward wave structure, the sign of the frequency change in the foregoing discussions would be reversed. For example, if the frequency is raised to achieve a result for a forward wave structure, it is lowered to achieve that result for a backward wave structure.

Changing the frequency of the electromagnetic wave can change the phase velocity of the wave so that, at each electron beam energy, the electron bunch can be on the average on the crest of the wave. The TW LINAC can be configured so that, for one particular energy, termed the synchronous energy, the buncher region and the accelerating structure of the LINAC can be designed so that the bunch is near the crest all the way through the LINAC. If the TW LINAC is to be operated over a large energy range, e.g., energies ranging from 3 MeV to 9 MeV, the synchronous energy can be chosen to be near the middle of the operating range.

If the input power (and hence amplitude) of the electromagnetic wave is lowered to lower the fields, and thus lower the energy of the electron beam, the fields can decrease uniformly throughout the LINAC. However, the effect of the decrease in power of the electromagnetic wave (including decreased electron velocity) can be more concentrated in the buncher region, since the velocity of the electrons becomes considerably less sensitive to the power of the electromagnetic wave once the electrons approach relativistic speeds. A change in phase velocity of the wave resulting from a change in frequency for a constant gradient forward wave TW LINAC can be small at the input end of the accelerator structure and large at the output end. The frequency controller can transmit a signal to change the frequency of an electromagnetic wave such that the electron bunch travels substantially behind the crest in the first third of the accelerator structure, to reach the crest by around the middle of the accelerator structure, and to be substantially ahead of the crest in the last third of the accelerator structure. In this example, the energy correlation as a function of position within the electron bunch that the electrons gain in the first third of their travel through the LINAC can be removed by traveling ahead of the crest in the last third of their travel through the LINAC. The frequency adjustment that removes the energy correlation as a function of position can also maximize the energy gain through the LINAC, and can maximize the x-ray yield.

For a given energy of operation, the optimum frequency and the set point of the frequency controller can be functions of both the energy and the beam current from the electron gun. The beam current from the electron gun can be varied to change the output energy of the electrons through the beam loading effect. In the beam loading effect, the electron beam bunched at the operating frequency of the LINAC can induce a field in the accelerator structure that has a phase that opposes the acceleration applied by the electromagnetic wave coupled into the LINAC, and can act to oppose the forward motion of the electrons. That is, beam loading can induce fields that act to decelerate the electron beam. The amplitude of these induced fields vary linearly with the magnitude of the beam current, and can rise roughly linearly with distance along the accelerator structure. A higher electron beam current can induce electric fields of higher amplitude that oppose the acceleration applied by the electromagnetic wave coupled into the LINAC, and result in the electron beam experiencing less acceleration. In effect, beam loading can decrease the amplitude of the electromagnetic wave. A desirable result of increasing the electron gun current (and hence the effect of beam loading) to lower the energy of the output electrons can be that the x-ray yield can be increased, for example, from the increased dose rate of electrons.

The beam loading effect can lower the energy of the electron beam, while having little effect on the transit time of the electron beam through the accelerator, since the electron beam induced fields are small at the input end where the electron beam is non-relativistic. If the power of the electromagnetic wave is raised in an effort to compensate for the lowered energy that can result from beam loading, the fields can change equally in all cavities of the accelerator structure and have a strong effect on the beam transit time through the accelerator structure. Thus, for each different energy in an interleaving operation, an adjustment in the set point of the frequency controller can be made to account for the different RF phase shifts through the LINAC that can occur for each different energy of operation, for example, due to the effect of beam loading.

In a multi-energy operation of the LINAC, the electron gun can be operated at a different beam current for each energy of operation. As discussed above, increasing the beam current for the lower energy operation can provide an increased x-ray yield at the lower energy than achieved by just lowering the amplitude of the electromagnetic wave from the klystron. Using a different beam current from the electron gun for each different energy of operation of the LINAC can help maintain the same x-ray intensity across the different energies of operation.

In another embodiment, an operator can choose a phase shift through the LINAC for each different energy which maximizes the x-ray yield for that energy. That is, an operator can choose the set point of the frequency controller for each different energy of operation. The frequency controller can then continuously adjust the frequency of the electromagnetic wave to maintain the phase of the electromagnetic wave at the preset phase set point for that energy. It has been demonstrated that a similar value of phase shift through the LINAC can optimize the electron spectrum (i.e., eliminate the energy correlation with position in the bunch along the longitudinal direction of the LINAC), maximize the energy, and maximize the x-ray yield. However, maximizing the x-ray yield can be sensitive to frequency and can be easy to perform.

In an embodiment, the frequency controller can maintain automatic control over the adjustments to the frequency of the electromagnetic wave in a feedback operation. In a non-limiting example, the frequency controller can be an automatic frequency controller (AFC).

In another embodiment, a frequency controller can maintain automatic control and adjust the frequency of the electromagnetic wave to stabilize the energy of the electrons output at a given energy of operation. The energy of the electrons are stabilized when the energy spectrum of the electrons is centered at or substantially near the desired energy of operation of the accelerator (i.e., the maximum attainable energy of the LINAC for the given electromagnetic fields), and the full-width at half-maximum of the energy spectrum of the output electrons is minimized (i.e., narrowed). All of the systems and methods disclosed herein are also applicable to this embodiment of the operation of the TW LINAC comprising the frequency controller. For example, the frequency controller can maintain automatic control and adjust the frequency of the electromagnetic wave to stabilize the energy of the electrons at each energy of operation. In this example, the frequency controller can compare a first output of electrons at an energy to a second output of electrons at that same energy, and frequency controller transmits a signal to an oscillator, and adjust the frequency of the electromagnetic wave to stabilize the output of electrons. The frequency of the electromagnetic wave can be varied on alternate pulses of the same energy to determine the behavior of the measured output of electrons versus frequency, and thus determine the change in frequency that can cause the output of electrons to peak around the desired energy, with minimized energy spread.

In another embodiment, the frequency controller can maintain automatic control and adjust the frequency of the electromagnetic wave to maximize the yield of x-rays at each energy (generated by contacting a target with the output electrons). For example, the frequency controller can transmit a signal to adjust the frequency of the electromagnetic wave based on the measured yield of x-rays. The maximum of the yield of x-rays at a given energy of the interleaving operation can be predetermined. The frequency of the electromagnetic wave can be varied on alternate pulses of the same energy to determine the behavior of the measured yield of x-rays versus frequency, and thus determine the change in frequency that can cause the yield to move towards the maximum. In this example, the yield of x-rays on two successive pulses at the same energy can be compared to determine the adjustment to the electromagnetic wave frequency. In a specific embodiment, the frequency can be varied by about 100 kHz on alternate pulses of the same energy, resulting in a change in phase through the structure of about 8 degrees of phase. With this frequency variation, the electron bunch can alternate between about 2 degrees forward and about 2 degrees behind the crest of the electromagnetic wave on successive pulses of the same energy.

The frequency controller can maintain automatic control over the adjustments to the frequency of the electromagnetic wave in a feedback operation. A feedback loop can be intricate and the convergence time to determine a frequency adjustment can be long. The convergence time can be reduced by making the frequency correction (or adjustment) proportional to the error signal. In the embodiment where the frequency controller is used to maximize the yield of x-rays at each energy of operation, the error signal can be determined as the difference between the x-ray yield from two pulses, divided by the sum of the x-ray yields from the two pulses. The energy of the beam can be approximated as a sine function of phase shift through the LINAC. Normalizing by the sum of the two x-ray yields can cause the error signal measure to be insensitive to changes in the x-ray measurement device. In the embodiment where the frequency controller is used to stabilize the energy of the output electrons at each energy of operation, the error signal can be determined as the difference between the electron current from two pulses, divided by the sum of the electron currents from the two pulses.

A frequency controller operated in a feedback operation can be used to correct for the effect of minor drifts of the electron gun current or minor drifts of the RF power (hence amplitude). That is, in addition to correcting for drifts in the temperature of the accelerator structure or drifts in the frequency of the oscillator.

6.4 X-Rays

In certain aspects, x-rays can be generated from the bombardment of a target material by the accelerated electron beam or electron bunches from a LINAC. The x-rays can be generated by two different mechanisms. In the first mechanisms, collision of the electrons from the LINAC an atom of a target can impart enough energy so that electrons from the atom's lower energy levels (inner shell) escape the atom, leaving vacancies in the lower energy levels. Electrons in the higher energy levels of the atom descend to the lower energy level to fill the vacancies, and emit their excess energy as x-ray photons. Since the energy difference between the higher energy level and the lower energy level is a discrete value, these x-ray photons (generally referred to as k-shell radiation) appear in the x-ray spectrum as sharp lines (called characteristic lines). K-shell radiation has a signature energy that depends on the target material. In the second mechanisms, the electron beams or bunches from the LINAC are scattered by the strong electric field near the atoms of the target and give off Bremsstrahlung radiation. Bremsstrahlung radiation produces x-rays photons in a continuous spectrum, where the intensity of the x-rays increases from zero at the energy of the incident electrons. That is, the highest energy x-ray that can be produced by the electrons from a LINAC is the highest energy of the electrons when they are emitted from the LINAC. The Bremsstrahlung radiation can be of more interest than the characteristic lines for many applications.

Materials useful as targets for generating x-rays include tungsten, certain tungsten alloys (such as but not limited to tungsten carbide, or tungsten (95%)-rhenium (5%)), molybdenum, copper, platinum and cobalt.

6.5 Instrumentation

Certain instruments which may be used in the operation of a traveling wave LINAC include a klystron modulator and an electromagnetic wave source.

6.5.1 Modulator

A modulator generates high-voltage pulses lasting a few microseconds. These high-voltage pulses can be supplied to the electromagnetic wave source (discussed in Section 6.5.2 below), to the electron gun (see Section 6.1 above), or to both simultaneously. A power supply provides DC voltage to the modulator, which converts this to the high-voltage pulses. For example, the Solid State Klystron Modulator −K1 or −K2 (ScandiNova Systems AB, Uppsala, Sweden) can be used in connection with a klystron.

6.5.2 Microwave Generators

The electromagnetic wave source can be any electromagnetic wave source deemed suitable by one of skill. The electromagnetic wave source (in the microwave of radio frequency ("RF") range) for the LINAC can be a klystron amplifier (discussed in Section 6.1 above). In a klystron, the size of the RF source and the power output capability are roughly proportional to the wavelength of the electromagnetic wave. The electromagnetic wave can be modified by changing its amplitude, frequency, or phase.

6.6 Exemplary Apparatus and Computer-Program Implementations

Aspects of the methods disclosed herein can be performed using a computer system, such as the computer system described in this section, according to the following programs and methods. For example, such a computer system can store and issue commands to facilitate modification of the electromagnetic wave frequency and power according to a method disclosed herein. In another example, a computer system can store and issue commands to facilitate operation of the frequency controller according to a method disclosed herein. The systems and methods may be implemented on various types of computer architectures, such as for example on a single general purpose computer, or a parallel processing computer system, or a workstation, or on a networked system (e.g., a client-server configuration such as shown in FIG. 10).

Figure 10:
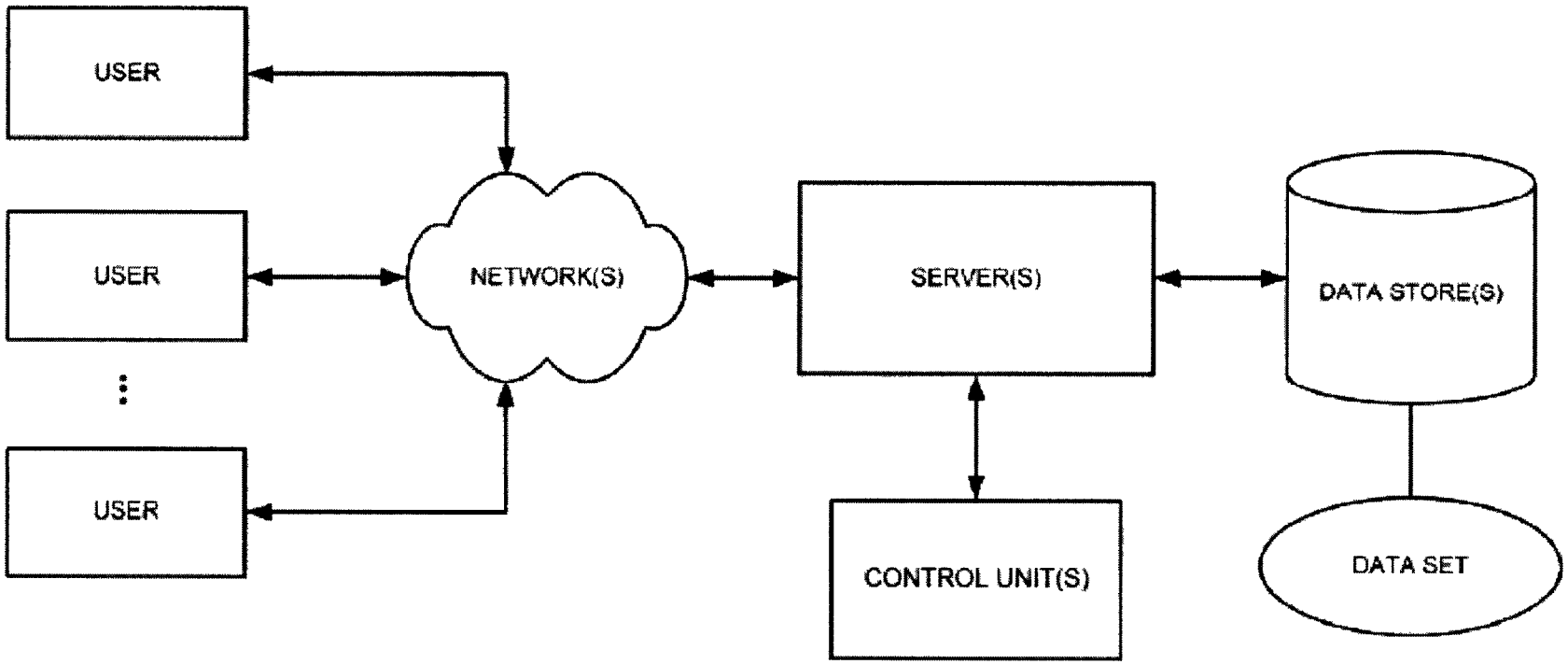
FIG. 10 shows a block diagram of an example computer structure for use in the operation of a TW LINAC comprising a frequency controller.

An exemplary computer system suitable for implementing the methods disclosed herein is illustrated in FIG. 10. As shown in FIG. 10, the computer system to implement one or more methods and systems disclosed herein can be linked to a network link which can be, e.g., part of a local area network ("LAN") to other, local computer systems and/or part of a wide area network ("WAN"), such as the Internet, that is connected to other, remote computer systems. A software component can include programs that cause one or more processors to issue commands to one or more control units, which cause the one or more control units to issue commands to cause the initiation of the frequency controller, to cause the initiation of the intensity controller, to operate the electromagnetic wave source to generate an electromagnetic wave at a frequency, and/or to operate the LINAC (including commands for coupling the electromagnetic wave into the LINAC). The programs can cause the system to retrieve commands for executing the steps of the methods in specified sequences, including initiating the frequency controller, computing the RF power(s), and operating the electromagnetic wave source to generate an electromagnetic wave at a frequency and at an RF power, from a data store (e.g., a database). The data store may be configured to store beam parameters such as the gun current, RF power, RF frequency, AFC phase set point, gun pulse length, gun timing, RF pulse length, and RF pulse timing for each electron beam. For example, for a 3-energy LINAC with 6 different intensities for each of the 3 energies, the data store would store the beam parameters for each of the 18 different beams (3 energies times 6 intensities). Such a data store can be stored on a mass storage (e.g., a hard drive) or other computer readable medium and loaded into the memory of the computer, or the data store can be accessed by the computer system by means of the network.

In addition to the exemplary program structures and computer systems described herein, other, alternative program structures and computer systems will be readily apparent to the skilled artisan. Such alternative systems, which do not depart from the above described computer system and programs structures either in spirit or in scope, are therefore intended to be comprehended within the accompanying claims.

6.7 Systems for Cargo Scanning

As noted above, the TW LINAC of the present invention suitably may be used in a variety of systems and methods, including systems and methods for cargo scanning or radiotherapy. An exemplary system for scanning cargo, and exemplary method for using the same, is described in this section with reference to FIGS. 11 and 12. An exemplary system for radiotherapy, and an exemplary method for using the same, is described further below in section 6.8 with reference to FIGS. 13 and 14.

Figure 11:
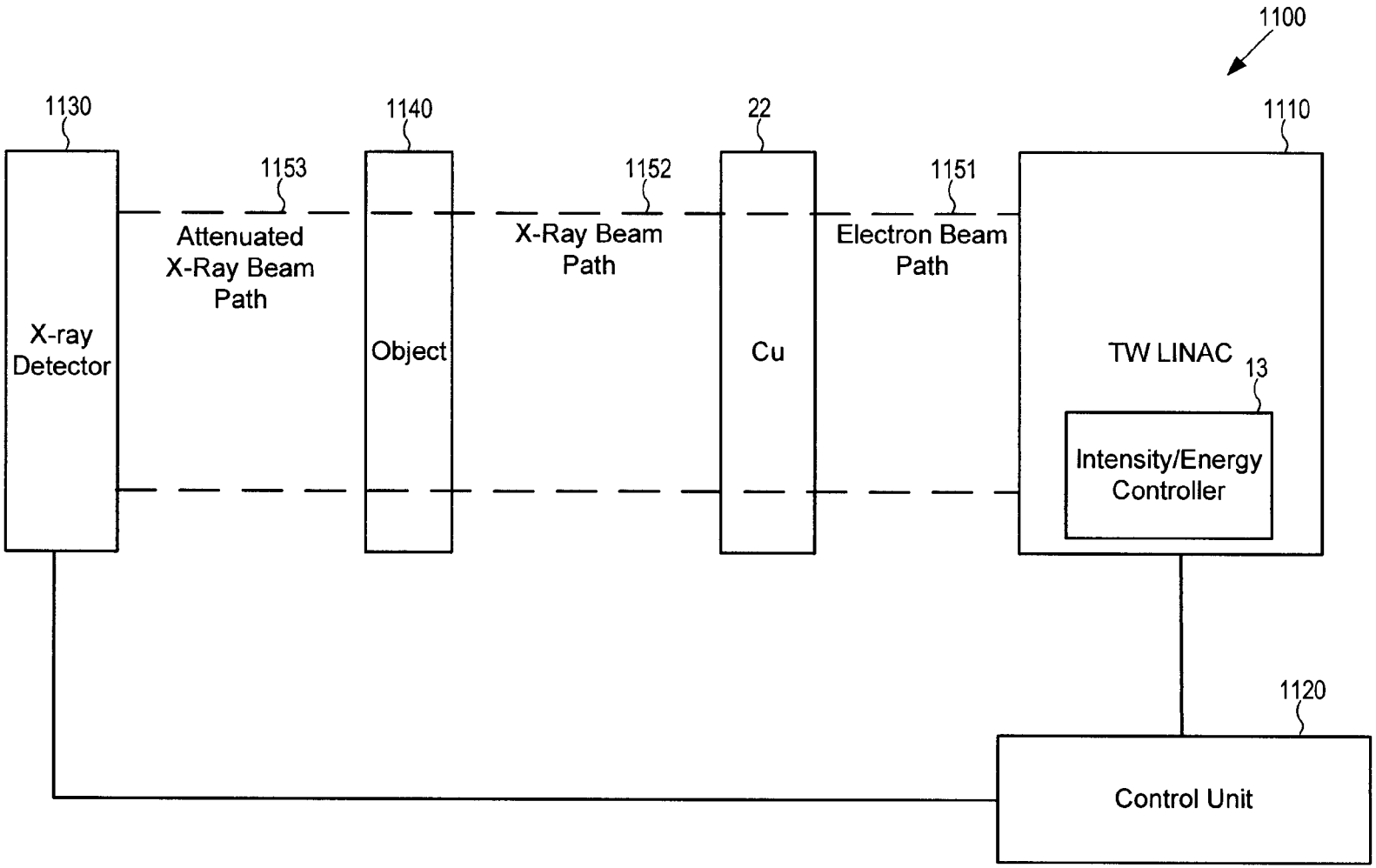
FIG. 11 illustrates a block diagram of a system for scanning cargo with a TW LINAC.

Referring to FIG. 11, an illustrative system 1100 for scanning cargo includes TW LINAC 1110, which may be substantially the same as the TW LINAC described above and which includes intensity controller 13 configured to adjust various parameters of the TW LINAC so as to provide an output dose rate and energy of electrons. System 1100 also includes control unit 1120, target 22 which may be substantially the same as target 22 described above, and x-ray detector 1130.

As described above, TW LINAC 1110 is configured to generate electron beams having selected doses and/or energies. The electron beams from TW LINAC 1110 travel along electron beam path 1151 and irradiate x-ray target 22, which may be considered to be part of TW LINAC 1110, and in the illustrative embodiment is copper (Cu). X-ray target 22 is configured to generate x-rays responsive to irradiation with electrons. The resulting x-rays, which also have selected doses and/or energies based on the particular configuration of TW LINAC 1110, travel along x-ray beam path 1152 and irradiate object 1140, which may be a cargo container, for example. The x-rays become attenuated as they travel through object 1140, based on the particular materials and thicknesses of materials in object 1140, and then travel along attenuated x-ray beam path 1153. X-ray detector 1130 is configured to detect the x-rays transmitted through object 1140.

Control unit 1120 is in operative communication with detector 1130 and with intensity controller 13 of TW LINAC 1110, and is configured to generate a plurality of intensity/energy adjustment commands corresponding to different desired combinations of output dose rates and energies. Each such intensity/energy adjustment command causes intensity controller 13 to determine a corresponding pulse width, beam injection time, and frequency adjustment factor to provide the respective desired output dose rate and energy of electrons. For each such intensity/energy adjustment command, intensity controller 13 then issues appropriate commands to the electron gun modulator 9, amplifier 3, and frequency controller 1 in the manner described above. Such commands cause TW LINAC 1110 to generate electrons having the respective output dose rate and energy. Control unit 1120 may issue such commands based on the percent transmission of x-rays through object 1140, as described in further detail below.

Specifically, control unit 1120 may be configured to cause TW LINAC 1110 to generate sequences of electron output dose rates and energies that are particularly well suited for use in cargo scanning operations, e.g., in which the electron energies and doses are selected so as to obtain sufficient transmission of x-rays through an object to sufficiently interrogate the object. Some of such sequences may be considered to constitute "dynamic intensity and energy variation," in that the energy and/or dose of the electrons may be increased or decreased as rapidly as on a pulse-to-pulse basis.

In some embodiments, the energy of the x-rays may be held constant, and the dose varied so as to provide increasing or decreasing amounts of x-rays through object 1140. For example, in circumstances where a first dose of x-rays at a given energy results in a percent transmission through object 1140 that is below a predetermined threshold, e.g., is insufficient to interrogate object 1140, the energy of the x-rays may be held constant and a second, increased dose of x-rays generated by issuing appropriate commands from control unit 1120 to intensity modulator 13. Such an increase may be particularly useful in that a greater dose of x-rays may increase the amount of information obtained about the object. Or, for example, in circumstances where a first dose of x-rays at a given energy results in a percent transmission through object 1140 that is above a predetermined threshold, e.g., is greater than required to interrogate object 1140, the energy of the x-rays may be held constant and a second, decreased dose of x-rays generated by issuing appropriate commands from control unit 1120 to intensity modulator 13. Such a decrease may be particularly useful in that lowering the dose of x-rays may reduce operator exposure to the x-rays.

In other embodiments, the dose of the x-rays may be held constant, and the energy varied so as to provide x-rays having increasing or decreasing energies through object 1140. It may be useful to hold the x-ray dose constant while varying the energy, because it allows images obtained at different energies to be directly compared to one another to characterize the object. For example, in circumstances where x-rays having a first energy at a given dose results in a percent transmission through object 1140 that is below a predetermined threshold, e.g., is insufficient to interrogate object 1140, the dose of the x-rays may be held constant and x-rays having a second, increased energy generated by issuing appropriate commands from control unit 1120 to intensity modulator 13. Such an increase may be particularly useful in that higher energy x-rays may better penetrate object 1140 and thus increase the amount of information obtained about the object. Or, for example, in circumstances where x-rays having a first energy at a given dose results in a percent transmission through object 1140 that exceeds a predetermined threshold e.g., is greater than required to interrogate object 1140, the dose of the x-rays may be held constant and x-rays having a second, decreased energy generated by issuing appropriate commands from control unit to intensity modulator 13. Such a decrease may be particularly useful in that lowering the energy of x-rays may reduce operator exposure to the x-rays. The energy of the electrons may be varied between several discrete energies, e.g., between 4 MeV, 6 MeV, and 9 MeV, or may be varied along a spectrum of possible energies, e.g., at any energy between 3 MeV and 9 MeV. Additionally, even if the x-ray dose is held constant, the corresponding output dose rate of electrons need not necessarily be constant, because different energies of electrons may generate x-rays with different yields. As such, a higher electron energy may more efficiently convert to x-rays than would a lower electron energy, so a lower output dose rate of electrons at the higher energy may be used to provide the same dose of x-rays as at the lower energy.

Figure 12:
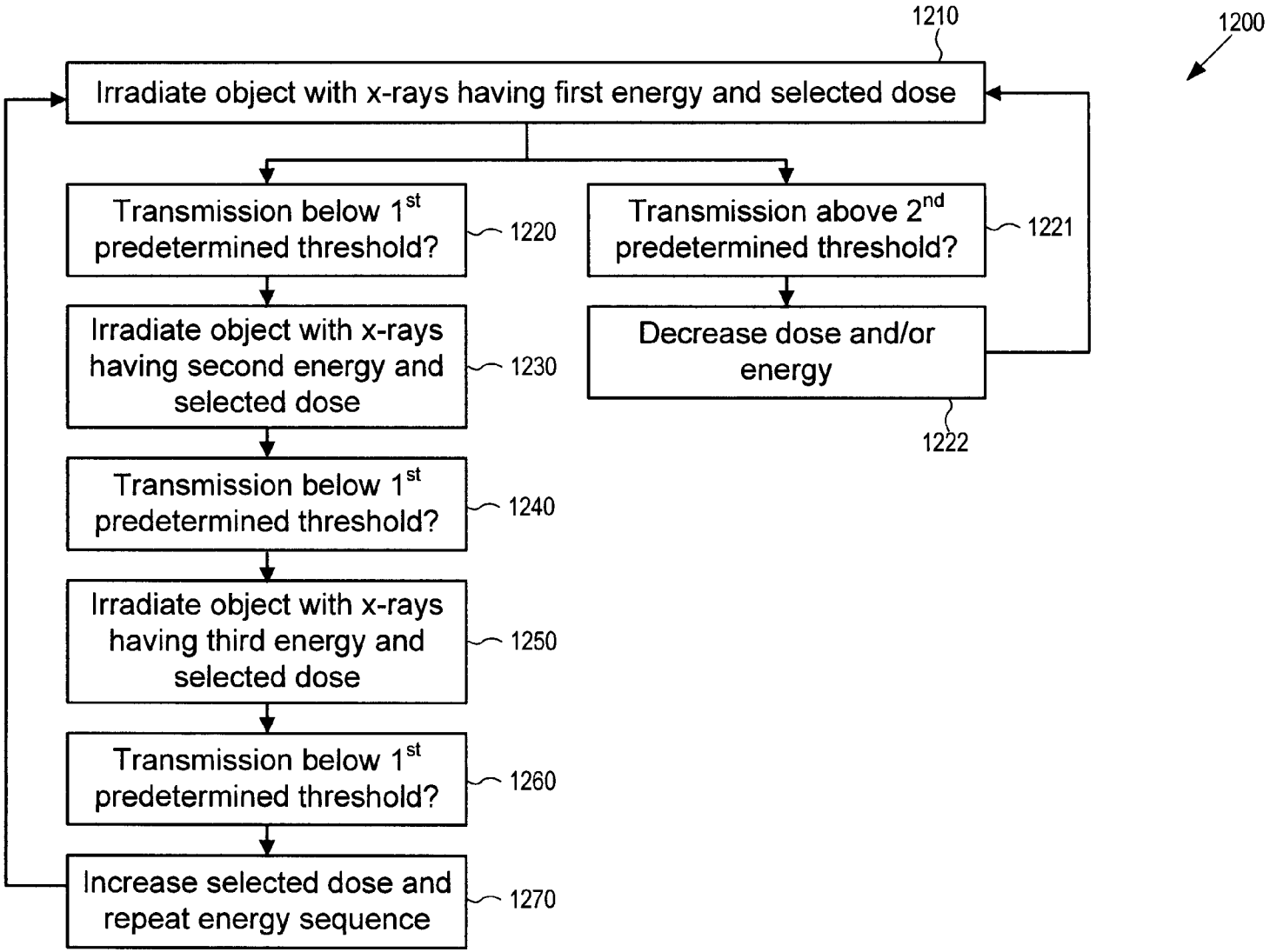
FIG. 12 illustrates a flow chart of an operation of the system of FIG. 11.

In still other embodiments, both the output dose rate and the energy of the electron beam may be dynamically varied so as to generate x-rays having dynamic intensity and energy variation, so as to sufficiently interrogate object 1140 while reducing operator exposure to x-rays. For example, as illustrated in FIG. 12, method 1200 includes irradiating an object with x-rays having a first energy and a selected dose (step 1210). For example, control unit 1120 may send a first intensity adjustment command to cause intensity controller 13 to determine a first pulse width, a first beam injection time, and a first frequency adjustment factor to provide a first output dose rate and first energy of a first set of electrons. A first set of x-rays generated by those electrons then pass through object 1140 and are detected by detector 1130. The dose and energy of the first set of x-rays is based on the first output dose rate and first energy of the first set of electrons.

Method 1200 also includes determining whether the percent transmission of the x-rays through the object is below a first predetermined threshold (step 1220). For example, control unit 1120 may obtain the percent transmission of the x-rays based on an output of detector 1130, and optionally also based on an output from x-ray yield monitor 31 described further above with reference to FIG. 2. Control unit 1120 may compare the percent transmission to the first predetermined threshold, which may be a value representative of a minimum dose of attenuated x-rays required to obtain a sufficiently clear image of object 1140.

If the percent transmission is below the first predetermined threshold, method 1200 also includes irradiating the object with a second set of x-rays having a second energy, which may be higher than the first energy, and with the same dose of x-rays as in step 1210 (step 1230). For example, control unit 1120 may send a second intensity adjustment command to cause intensity controller 13 to determine a second pulse width, a second beam injection time, and a second frequency adjustment factor to provide a second output dose rate and second energy of a second set of electrons. A second set of x-rays generated by those electrons then pass through object 1140 and are detected by detector 1130. The dose and energy of the second set of x-rays is based on the second output dose rate and second energy of the second set of electrons. As noted above, although the dose of the second set of x-rays may be the same as that of the first set of x-rays, the output dose rate of the second set of electrons may be different from the output dose rate of the first set of electrons, depending on the degree to which the conversion efficiency of electrons to x-rays varies with electron energy. The intensity controller may be configured to select the second output dose rate of the second set of electrons such that a dose of the second set of x-rays is substantially the same as the dose of the first set of x-rays.

Method 1200 also includes determining whether the percent transmission of the x-rays of step 1230 through the object is below a first predetermined threshold (step 1240). For example, control unit 1120 may obtain the percent transmission of the x-rays of step 1230 based on an output of detector 1130, and optionally also based on an output from x-ray yield monitor 31 described further above with reference to FIG. 2. Control unit 1120 may compare the percent transmission to the first predetermined threshold, which may be a value representative of a minimum dose of attenuated x-rays required to obtain a sufficiently clear image of object 1140.

If the percent transmission is below the first predetermined threshold, method 1200 also includes irradiating the object with a third set of x-rays having a third energy, which may be higher than the second energy, and with the same dose of x-rays as in steps 1210 and 1230 (step 1250). For example, control unit 1120 may send a third intensity adjustment command to cause intensity controller 13 to determine a third pulse width, a third beam injection time, and a third frequency adjustment factor to provide a third output dose rate and third energy of a first set of electrons. A third set of x-rays generated by those electrons then pass through object 1140 and are detected by detector 1130. The dose and energy of the third set of x-rays is based on the third output dose rate and third energy of the first set of electrons. The third set of x-rays may have a higher energy than the second set of x-rays. However, although the dose of the third set of x-rays may be the same as that of the first and second sets of x-rays, the output dose rate of the third set of electrons may be different from the output dose rate of the first and/or set of electrons, depending on the degree to which the conversion efficiency of electrons to x-rays varies with electron energy. The intensity controller may be configured to select the third output dose rate of the third set of electrons such that a dose of the third set of x-rays is substantially the same as the doses of the first and second sets of x-rays Method 1200 also includes determining whether the percent transmission of the x-rays of step 1250 through the object is below a first predetermined threshold (step 1260). For example, control unit 1120 may obtain the percent transmission of the x-rays of step 1230 based on an output of detector 1130, and optionally also based on an output from x-ray yield monitor 31 described further above with reference to FIG. 2. Control unit 1120 may compare the percent transmission to the first predetermined threshold, which may be a value representative of a minimum dose of attenuated x-rays required to obtain a sufficiently clear image of object 1140.

If the percent transmission is below the first predetermined threshold, method 1200 also includes increasing the selected dose, and then repeating the same energy sequence as set forth in steps 1210 through 1260 (step 1270). As such, the next energy generated may be lower than the third energy, but the next dose may be higher than the third dose.

Method 1200 also includes determining whether the percent transmission of the x-rays of step 1210 through the object is above a second predetermined threshold (step 1221). For example, control unit 1120 may obtain the percent transmission of the x-rays based on an output of detector 1130, and optionally also based on an output from x-ray yield monitor 31 described further above with reference to FIG. 2. Control unit 1120 may compare the percent transmission to the second predetermined threshold, which may be a value representative of a maximum dose of attenuated x-rays required to obtain a sufficiently clear image of object 1140.

If the percent transmission is above the second predetermined threshold, method 1200 includes decreasing the dose and/or energy of the next set of x-rays generated (step 1222). For example, control unit 1120 may send a second intensity adjustment command to cause intensity controller 13 to determine a second pulse width, a second beam injection time, and a second frequency adjustment factor to provide a second output dose rate and second energy of a second set of electrons. A second set of x-rays generated by those electrons then pass through object 1140 and are detected by detector 1130. The dose and energy of the second set of x-rays is based on the second output dose rate and second energy of the second set of electrons. The intensity controller may be configured to select the second output dose rate of the second set of electrons such that a dose of the second set of x-rays is less than the dose of the first set of x-rays.

It will be appreciated that sequences of doses and energies other than those described above may readily be employed for scanning cargo, or for other purposes.

6.8 Systems for Radiotherapy

An exemplary system for radiotherapy, and an exemplary method for using the same, will now be described with reference to FIGS. 13 and 14.

Figure 13:
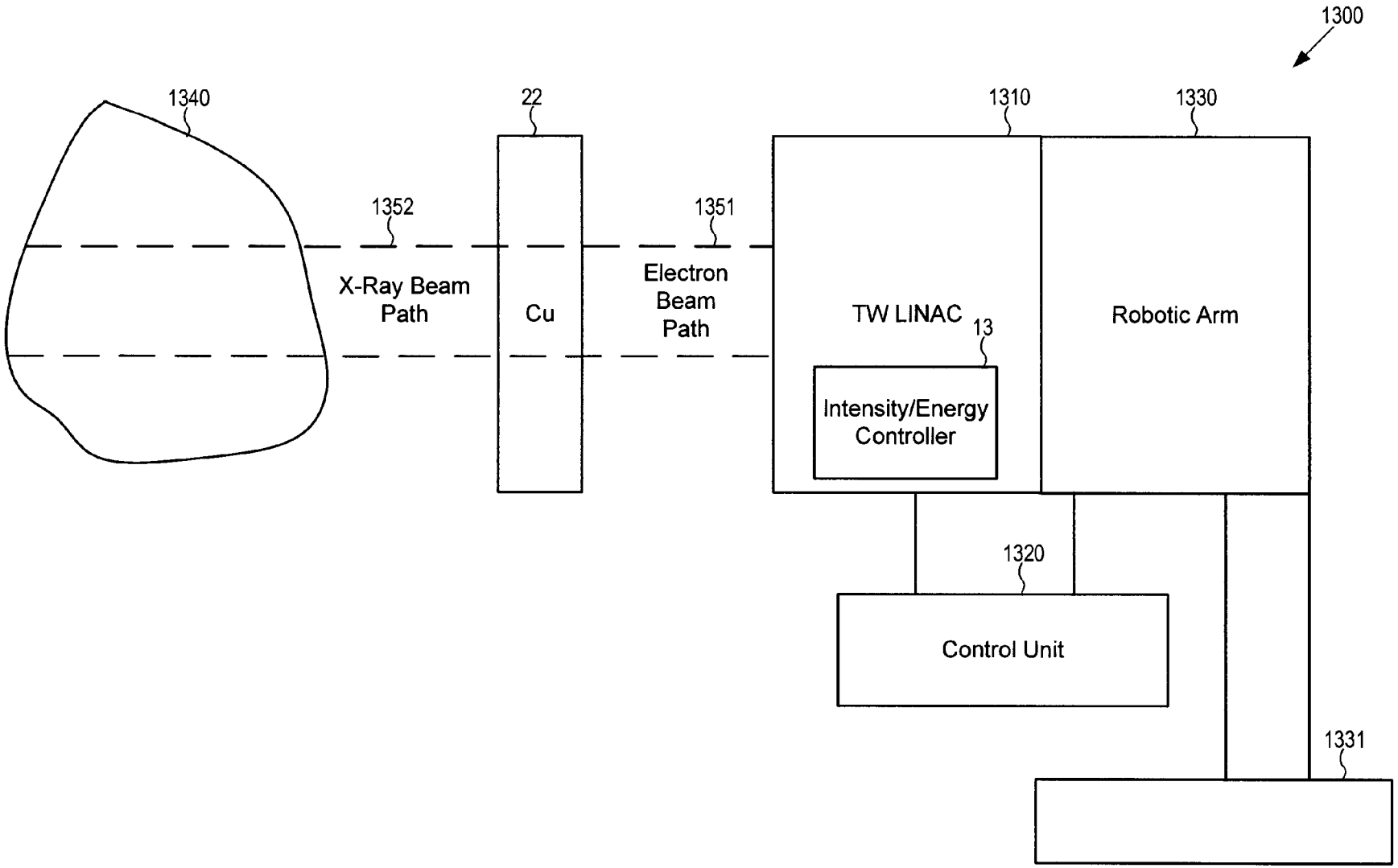
FIG. 13 illustrates a block diagram of a system for performing radiometry with a TW LINAC.

Referring to FIG. 13, an illustrative system 1300 for radiotherapy includes TW LINAC 1310, which may be substantially the same as TW LINAC 1110 described above and which includes intensity controller 13 configured to adjust various parameters of the TW LINAC so as to provide an output dose rate and energy of electrons. System 1300 also includes control unit 1320, target 22 which may be substantially the same as target 22 described above, and robotic arm 1330 on stand 1331.

As described above, TW LINAC 1310 is configured to generate electron beams having selected doses and/or energies. The electron beams from TW LINAC 1310 travel along electron beam path 1351 and irradiate x-ray target 22, which may be considered to be part of TW LINAC 1310, and in the illustrative embodiment is copper (Cu). X-ray target 22 is configured to generate x-rays responsive to irradiation with electrons. The resulting x-rays, which also have selected doses and/or energies based on the particular configuration of TW LINAC 1310, travel along x-ray beam path 1352 and irradiate tumor volume 1340, which may be a cancer tumor, for example. Robotic arm 1330 is configured to modify the angle at which the x-rays irradiate tumor volume 1340. As illustrated in FIG. 13, the x-rays may be relatively narrowly collimated so as to have a relatively high intensity within tumor volume 1340, so as to cause necrosis (tissue death) within the volume when the volume is repeatedly irradiated from multiple angles under control of robotic arm 1330, but preferably without significantly damaging the surrounding tissue.

Control unit 1320 is in operative communication with robotic arm 1330 and with intensity controller 13 of TW LINAC 1310, and is configured to generate a plurality of intensity/energy adjustment commands corresponding to different desired combinations of output dose rates and energies. Each such intensity/energy adjustment command causes intensity controller 13 to determine a corresponding pulse width, beam injection time, and frequency adjustment factor to provide the respective desired output dose rate and energy of electrons. For each such intensity/energy adjustment command, intensity controller 13 then issues appropriate commands to the electron gun modulator 9, amplifier 3, and frequency controller 1 in the manner described above. Such commands cause TW LINAC 1310 to generate electrons having the respective output dose rate and energy. Control unit 1320 also is configured to issue commands causing robotic arm 1330 to adjust the angle at which the x-rays irradiate tumor volume 1340. Control unit 1320 may issue such commands to intensity controller 13 and to robotic arm 1330 so as to achieve substantially homogenous irradiation of tumor volume 1340, as described in further detail below.

Specifically, control unit 1320 may be configured to cause TW LINAC 1310 to generate sequences of electron output dose rates and energies that are particularly well suited for use in radiotherapy operations, e.g., in which the electron energies and doses are selected so as to more homogenously irradiate tumor volume 1340 when combined with angular control over the irradiation by robotic arm 1330. Some of such sequences may be considered to constitute "dynamic intensity and energy variation," in that the energy and/or dose of the electrons may be increased or decreased as rapidly as on a pulse-to-pulse basis.

For example, at a given angle of irradiation and a given dose, the energies of x-rays may be controlled so as to irradiate tumor volume 1340 at varying depths. For example, x-rays having a low energy may penetrate tumor volume 1340 to a relatively low extent, and thus primarily may be used to irradiate more superficial regions of tumor volume 1340. In comparison, x-rays having a higher energy may penetrate tumor volume 1340 to a greater extent, and thus primarily may be used to irradiate deeper regions of tumor volume 1340. However, the higher and lower energies of x-rays both may irradiate the same portion of tumor volume 1340, albeit with different respective doses than one another in any given section of that portion. As such, the doses and energies of all x-ray beams that irradiate a given section determine the composite dose received by that section at a given angle. The angles may be varied to irradiate different portions of the tumor so as to fully treat the tumor. According to the present invention, the doses, energies, and angles of the x-rays preferably are selected so that each section of the tumor volume 1340 receives a desired dose of x-rays, which in some embodiments is substantially the same dose of radiation as each other section of the tumor volume.

Figure 14:
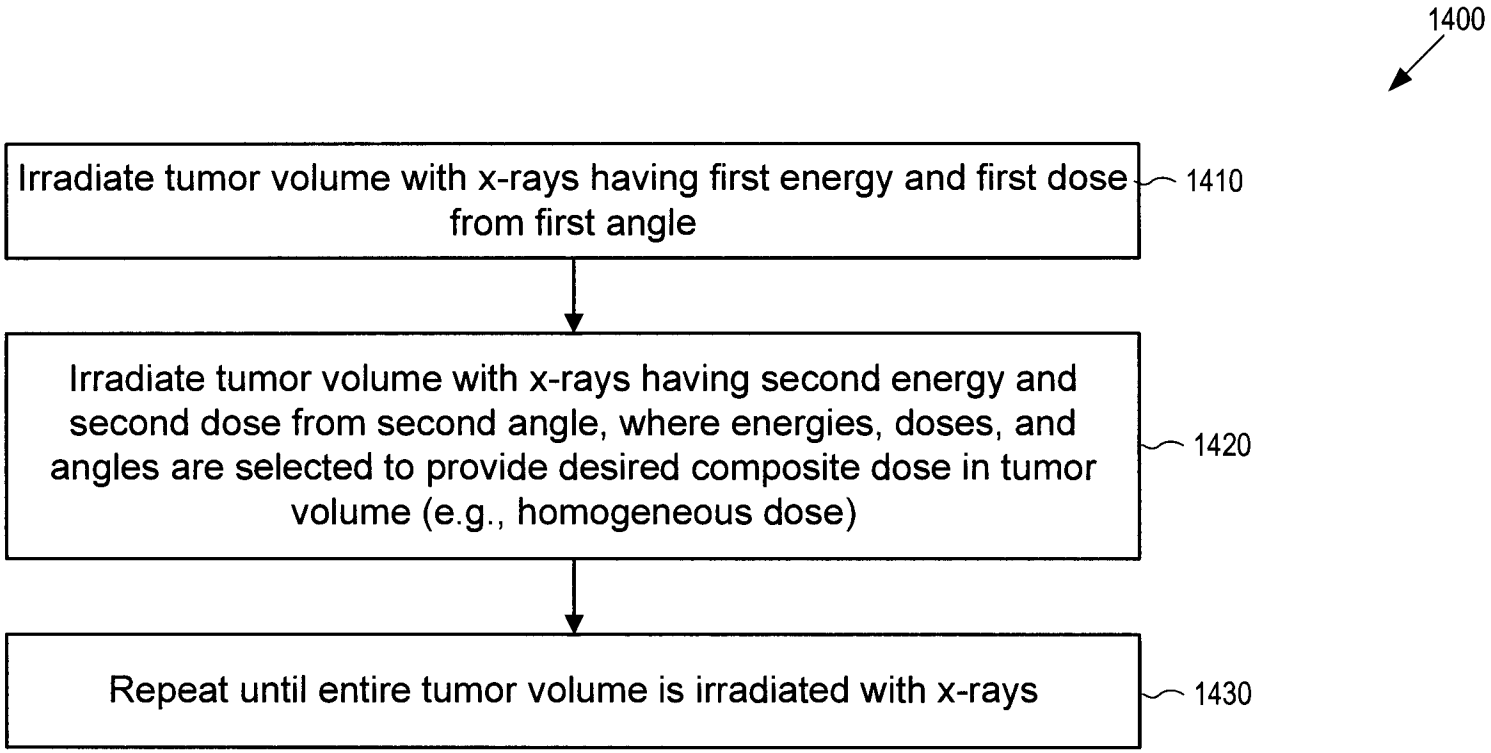
FIG. 14 illustrates a flow cart of an operation of the system of FIG. 13.

For example, method 1400 illustrated in FIG. 14 illustrates method 1400 that may be used with system 1300 of FIG. 13 in a radiotherapy operation. Method 1300 includes irradiating a tumor volume with x-rays having a first energy and a first dose, from a first angle (step 1410). For example, control unit 1320 may send a first intensity adjustment command to cause intensity controller 13 to determine a first pulse width, a first beam injection time, and a first frequency adjustment factor to provide a first output dose rate and first energy of a first set of electrons. Control unit 1320 also may send a first position command to robotic arm 1330 to cause the robotic arm to adjust the angle of irradiation, such that a first portion of the tumor volume is irradiated with x-rays generated by the first set of electrons. The dose and energy of the first set of x-rays is based on the first output dose rate and first energy of the first set of electrons.

Method 1400 also includes irradiating a tumor volume with x-rays having a second energy and a second dose, from a second angle (step 1420). For example, control unit 1320 may send a second intensity adjustment command to cause intensity controller 13 to determine a second electron pulse width, a second beam injection time, and a second frequency adjustment factor to provide a second output dose rate and second energy of a second set of electrons. Control unit 1320 also may send a second position command to robotic arm 1330 to cause the robotic arm to adjust the angle of irradiation, such that a second portion of the tumor volume is irradiated with x-rays generated by the second set of electrons. The dose and energy of the second set of x-rays is based on the second output dose rate and second energy of the second set of electrons. The energy of the second set of x-rays may be the same as, higher than, or lower than, the energy of the first set of x-rays. Similarly, the dose of the second set of x-rays may be the same as, higher than, or lower than, the energy of the first set of x-rays. Further, the angle of the second set of x-rays may be the same as, or different than, the angle of the first set of x-rays. However, at least one of these three parameters (energy, dose, and angle) is different between the first and second sets of x-rays, and each of the parameters is selected such that the tumor volume is irradiated with a desired composite dose (e.g., a homogeneous dose).

Steps 1410 and 1420 are repeated for different portions of the tumor volume, until the entire volume is irradiated with x-rays (step 1430). In one preferred embodiment, the energies, doses, and angles are selected such that each portion of the tumor volume receives substantially the same dose of x-rays as each other portion.

7. MODIFICATIONS

Many modifications and variations of this invention can be made without departing from its spirit and scope, as will be apparent to those skilled in the art. For example, other types of linear accelerators suitably may be used to generate X-ray energy and dose sequences analogous to those described herein. The specific embodiments described herein are offered by way of example only, and the invention is to be limited only by the terms of the appended claims, along with the full scope of equivalents to which such claims are entitled.

What is claimed is:

1. A traveling wave linear accelerator for generating a plurality of dose rates and energies of electrons, the traveling wave linear accelerator comprising:

an electron gun modulator configured to adjust a pulse width and a beam injection time of a beam of electrons from an electron gun;

a frequency/power controller configured to determine a frequency and a power of a radio frequency (RF) signal to be generated; and an intensity controller operatively associated with the electron gun modulator and the frequency/power controller, the intensity controller configured to receive a plurality of intensity/energy adjustment commands and to respectively determine a pulse width, a beam injection time, an RF power factor, and a frequency adjustment factor based on each intensity/energy adjustment command to provide a respective output dose rate and energy of electrons;

wherein, for each intensity/energy adjustment command, the electron gun modulator receives the determined pulse width and the determined beam injection time and adjusts the pulse width and the beam injection time of the beam of electrons and the frequency/power controller receives the frequency adjustment factor and the RF power factor and adjusts the frequency and power of the RF signal such that the traveling wave linear accelerator generates electrons having the respective output dose rate and energy.

2. The traveling wave linear accelerator of claim 1, further comprising:

an x-ray target configured to generate x-rays responsive to irradiation with electrons, the x-rays irradiating a cargo container; and a detector configured to detect x-rays transmitted through the container.

3. The traveling wave linear accelerator of claim 2, further comprising a control unit operatively associated with the detector and with the intensity controller, the control unit being configured:

to send a first intensity/energy adjustment command to cause the intensity controller to determine a first pulse width, a first beam injection time, a first RF power factor and a first frequency adjustment factor to provide a first output dose rate and first energy of a first set of electrons;

to determine a percent transmission of a first set of x-rays through the container based on an output of the detector, the first set of x-rays being generated by the first set of electrons; and if the percent transmission is below a predetermined threshold, to send a second intensity/energy adjustment command to cause the intensity controller to determine a second pulse width, a second beam injection time, a second RF power factor, and a second frequency adjustment factor to provide a second output dose rate and second energy of a second set of electrons.

4. The traveling wave linear accelerator of claim 3, wherein the second energy is higher than the first energy.

5. The traveling wave linear accelerator of claim 4, wherein the intensity controller is configured to select the second output dose rate of the second set of electrons such that a dose of the first set of x-rays is about the same as a dose of a second set of x-rays generated by the second set of electrons.

6. The traveling wave linear accelerator of claim 3, wherein the control unit is configured:

to determine a percent transmission of a second set of x-rays through the container based on an output of the detector, the second set of x-rays being generated by the second set of electrons; and if the percent transmission is below a predetermined threshold, to send a third intensity/energy adjustment command to cause the intensity controller to determine a third pulse width, a third beam injection time, a third RF power factor, and a third frequency adjustment factor to provide a third output dose rate and third energy of a third set of electrons.

7. The traveling wave linear accelerator of claim 6, wherein the third energy is higher than the second energy.

8. The traveling wave linear accelerator of claim 7, wherein the intensity controller is configured to select the third output dose rate of the third set of electrons such that a dose of the second set of x-rays is about the same as a dose of a third set of x-rays generated by the third set of electrons.

9. The traveling wave linear accelerator of claim 6, wherein the third energy is lower than the second energy and wherein the intensity controller is configured to select the third output dose rate of the third set of electrons such that a dose of a third set of set x-rays is greater than a dose of the first set of x-rays generated by the first set of electrons.

10. The traveling wave linear accelerator of claim 2, further comprising a control unit operatively associated with the detector and with the intensity controller, the control unit being configured:

to send a first intensity/energy adjustment command to cause the intensity controller to determine a first pulse width, a first beam injection time, a first RF power factor, and a first frequency adjustment factor to provide a first output dose rate and first energy of a first set of electrons;

to determine a percent transmission of a first set of x-rays through the container based on an output of the detector, the first set of x-rays being generated by the first set of electrons; and if the percent transmission is above a predetermined threshold, to send a second intensity/energy adjustment command to cause the intensity controller to determine a second pulse width, a second beam injection time, a second RF power factor, and a second frequency adjustment factor to provide a second output dose rate and a second energy of a second set of electrons.

11. The traveling wave linear accelerator of claim 10, wherein the intensity controller is configured to select the second output dose rate of the second set of electrons such that a dose of a second set of x-rays generated by the second set of electrons is less than a dose of the first set of x-rays.

12. The traveling wave linear accelerator of claim 1, further comprising:

an x-ray target configured to generate x-rays responsive to irradiation with electrons from the traveling wave linear accelerator, the x-rays being configured to irradiate a tumor volume; and a robotic arm on which the x-ray target and the linear accelerator are mounted and configured to adjust an angle at which the x-rays irradiate the tumor volume.

13. The traveling wave linear accelerator of claim 12, further comprising a control unit operatively associated with the robotic arm and with the intensity controller, the control unit being configured:

to send a first intensity/energy adjustment command to cause the intensity controller to determine a first pulse width, a first beam injection time, a first RF power factor, and a first frequency adjustment factor to provide a first output dose rate and a first energy of a first set of electrons;

to send a first position command to the robotic arm to cause the robotic arm to adjust the angle to irradiate a first portion of the tumor volume with x-rays generated by the first set of electrons;

to send a second intensity/energy adjustment command to cause the intensity controller to determine a second pulse width, a second beam injection time, a second RF power factor, and a second frequency adjustment factor to provide a second output dose rate and a second energy of a second set of electrons; and to send a second position command to the robotic arm to cause the robotic arm to adjust the angle to irradiate a second portion of the tumor volume with x-rays generated by the second set of electrons.

14. The traveling wave linear accelerator of claim 13, wherein the second energy is higher than the first energy.

15. The traveling wave linear accelerator of claim 14, wherein the second tumor volume is deeper than the first tumor volume.

16. The traveling wave linear accelerator of claim 13, wherein the first tumor volume and the second tumor volume receive about the same doses of x-rays as one another.

17. The traveling wave linear accelerator of claim 1, wherein the frequency/power controller is further configured to determine a pulse risetime of the RF signal to be generated, wherein the intensity controller is further configured to determine a pulse risetime factor based on each intensity/energy adjustment command, and wherein the frequency/power controller is further configured to receive the pulse risetime factor from the intensity controller and to adjust the pulse risetime of the RF signal.

18. A method for generating a plurality of dose rates and energies of electrons using a traveling wave linear accelerator, the traveling wave linear accelerator comprising an electron gun modulator configured to adjust a pulse width and a beam injection time of a beam of electrons from an electron gun and a frequency/power controller configured to adjust a frequency and a power of a radio frequency (RF) signal to be generated, the method comprising:

receiving at an intensity controller a plurality of intensity/energy adjustment commands and respectively determining a pulse width, a beam injection time, an RF power factor, and a frequency adjustment factor based on each intensity/energy adjustment command to provide a respective dose rate and energy of electrons; and for each intensity/energy adjustment command:

adjusting the pulse width and beam injection time of electrons from the electron gun at the electron gun modulator using the determined pulse width and the determined beam injection time;

determining the frequency and power of the RF signal to be generated at the frequency/power controller based on the RF power factor and the frequency adjustment factor; and generating electrons having the respective output dose rate and energy using the traveling wave linear accelerator.

19. The method of claim 18, further comprising:

sending a first intensity/energy adjustment command to cause the intensity controller to determine a first pulse width, a first RF power factor and a first frequency adjustment factor to provide a first output dose rate and first energy of a first set of electrons;

generating x-rays with the first set of electrons;

irradiating a cargo container with the x-rays;

determining a percent transmission of a first set of x-rays through the container based on an output of the detector; and if the percent transmission is below a predetermined threshold, sending a second intensity/energy adjustment command to cause the intensity controller to determine a second pulse width, a second beam injection time, a second RF power factor, and a second frequency adjustment factor to provide a second output dose rate and second energy of a second set of electrons.

20. The method of claim 18, further comprising:

sending a first intensity/energy adjustment command to cause the intensity controller to determine a first pulse width, a first beam injection time, a first RF power factor, and a first frequency adjustment factor to provide a first output dose rate and a first energy of a first set of electrons;

sending a first position command to a robotic arm on which the linear accelerator and an x-ray target are mounted to cause the robotic arm to adjust an angle to irradiate a first portion of a tumor volume with x-rays generated by the first set of electrons;

sending a second intensity/energy adjustment command to cause the intensity controller to determine a second pulse width, a second beam injection time, a second RF power factor, and a second frequency adjustment factor to provide a second output dose rate and a second energy of a second set of electrons; and sending a second position command to the robotic arm to cause the robotic arm to adjust the angle to irradiate a second portion of the tumor volume with x-rays generated by the second set of electrons.

21. The method of claim 18, further comprising determining at the intensity controller a pulse risetime factor based on each intensity/energy adjustment command, and adjusting a pulse risetime of the RF signal based on the pulse risetime factor.

* * * * *